US007482751B2

(12) United States Patent
Kim et al.

(10) Patent No.: US 7,482,751 B2
(45) Date of Patent: Jan. 27, 2009

(54) PLASMA DISPLAY PANEL

(75) Inventors: Sang-Hyun Kim, Yongin-si (KR); Joon-Hyeong Kim, Yongin-si (KR); Jung-Suk Song, Yongin-si (KR)

(73) Assignee: Samsung SDI Co., Ltd., Suwon-si (KR)

( * ) Notice: Subject to any disclaimer, the term of this patent is extended or adjusted under 35 U.S.C. 154(b) by 0 days.

(21) Appl. No.: 11/776,849

(22) Filed: Jul. 12, 2007

(65) Prior Publication Data

US 2008/0088238 A1 Apr. 17, 2008

(30) Foreign Application Priority Data

| | | |
|---|---|---|
| Oct. 17, 2006 | (KR) | 10-2006-0100821 |
| Oct. 17, 2006 | (KR) | 10-2006-0100822 |
| Nov. 9, 2006 | (KR) | 10-2006-0110475 |
| Nov. 27, 2006 | (KR) | 10-2006-0117959 |
| Dec. 22, 2006 | (KR) | 10-2006-0132642 |

(51) Int. Cl.
*H01J 17/49* (2006.01)

(52) U.S. Cl. ..... 313/582; 313/586

(58) Field of Classification Search ..... 313/582, 313/584, 586, 587

See application file for complete search history.

(56) References Cited

U.S. PATENT DOCUMENTS

| | | | | |
|---|---|---|---|---|
| 4,803,402 | A * | 2/1989 | Raber et al. | 313/509 |
| 6,013,983 | A * | 1/2000 | Asano et al. | 313/581 |

FOREIGN PATENT DOCUMENTS

| | | |
|---|---|---|
| JP | 2001-185037 | 7/2001 |
| JP | 2001-256894 | 9/2001 |
| JP | 2003-142006 | 5/2003 |
| JP | 2006-128070 | 5/2006 |
| KR | 1999-0058458 | 7/1999 |
| KR | 2001-68301 | 7/2001 |
| KR | 2005-0034385 | 4/2005 |
| KR | 2006-61150 | 6/2006 |
| KR | 2006-104535 | 10/2006 |

OTHER PUBLICATIONS

Notice of Decision issued in Korean Patent Application No. 2006-100822 on Jul. 21, 2008.

* cited by examiner

*Primary Examiner*—Vip Patel
(74) *Attorney, Agent, or Firm*—Stein, McEwen & Bui, LLP

(57) ABSTRACT

A plasma display panel includes: a first substrate; a second substrate facing the first substrate; barrier ribs disposed between the first and second substrates to partition a plurality of discharge cells; address electrodes formed on the first substrate to extend in a first direction corresponding to the discharge cells; display electrodes formed on the second substrate to extend in a second direction intersecting the first direction corresponding to the discharge cells; phosphor layers formed in inner portions of the discharge cells; and a dielectric layer formed on the second substrate to cover the display electrodes, wherein the dielectric layer is constructed with a plurality of layers having different refractive indexes.

20 Claims, 24 Drawing Sheets

PLASMA DISPLAY PANEL

CROSS-REFERENCE TO RELATED APPLICATIONS

This application claims the benefit of Korean Patent Applications Nos. 2006-100821 filed on Oct. 17, 2006, 2006-100822 filed on Oct. 17, 2006, 2006-110475 filed on Nov. 9, 2006, 2006-117959 filed on Nov. 27, 2006, and 2006-132642 filed on Dec. 22, 2006 in the Korean Intellectual Property Office, the disclosures of which are incorporated herein by reference.

BACKGROUND OF THE INVENTION

1. Field of the Invention

Aspects of the present invention relate to a plasma display panel, and more particularly, to a plasma display panel capable of improving display quality by reducing or preventing halation of visible light, halation being a spreading of visible light emitted from discharge cells into adjacent discharge cells due to refraction and reflection of the visible light that propagates through a front substrate thereof.

2. Description of the Related Art

In general, a plasma display panel (hereinafter, referred to as a PDP) uses a vacuum ultra violet (VUV) ray emitted from plasma, the ray being generated by way of a gas discharge and a phosphor material excitation. The excited phosphor material generates red (R), green (G), and/or blue (B) visible beams, so that an image can be displayed.

With the PDP, a very large screen of greater than 60 inches can be formed to have a thickness of less than 10 cm. Since the PDP is a self emission device like a CRT (a cathode-ray tube), a color reproduction thereof is excellent, and distortions caused when viewing angles are changed do not occur. Further, the manufacturing process of the PDP is simpler than an LCD (a liquid crystal display), providing advantages in terms of productivity and cost. Therefore, the PDP is highly anticipated as being a next generation commercial flat display and a home television set.

In general, in an AC (alternating-current) surface discharge PDP, pairs of electrodes are disposed on a first substrate that face each other, and address electrodes are disposed on a second substrate that faces the first substrate. A space is interposed between the first and the second substrates. In the space between the first substrate and the second substrate, a plurality of discharge cells is arrayed at the intersections of the electrodes and the address electrodes. Each of the discharge cells is partitioned by barrier ribs. Inner sides of the discharge cells are coated with phosphor layers, and inner spaces of the discharge cells are filled with a discharge gas.

In the PDP, millions of the discharge cells are arrayed in a matrix pattern. The discharge cells are selectively turned on and off by using a memory effect of wall charges. During operation, the selected discharge cells are discharged, and visible light is generated.

Visible light generated from the discharge cells is transmitted through the first substrate, an upper dielectric layer covering the first substrate, and a protective layer, so that an image can be displayed.

When the visible light propagates through the first substrate, the upper dielectric layer, the protective layer, as well as air, and other layers, the visible light undergoes refraction, reflection, and/or scattering at interfaces between the layers. As a result, there is deterioration in transmittance of the visible light.

In addition, when the visible light propagates from a dense medium, such as the first substrate, into such a sparse medium, such as the air, a refraction angle of the visible light becomes larger than an incidence angle of the visible light. Moreover, visible light having the incidence angle that is larger than a critical incidence angle undergoes total reflection at the interfaces under such conditions.

In a related-art PDP, when the refraction angle of the visible light becomes large or when the visible light undergoes total reflection, the halation of the visible light occurs, halation being a spreading of the visible light into adjacent discharge cells. As a result, deterioration in display quality occurs.

SUMMARY OF THE INVENTION

Aspects of the present invention provides a plasma display panel capable of improving display quality by preventing or reducing halation, halation being a spreading of visible light into adjacent discharge cells, and other advantages.

According to one aspect of the present invention, a plasma display panel includes: a first substrate; a second substrate facing the first substrate; barrier ribs disposed between the first and second substrates to partition a plurality of discharge cells; address electrodes formed on the first substrate to extend in a first direction to correspond to the discharge cells; display electrodes formed on the second substrate to extend in a second direction that intersects the first direction and to correspond to the discharge cells; and a dielectric layer formed on the second substrate to cover the display electrodes, wherein the dielectric layer is constructed with a plurality of layers having different refractive indexes.

The refractive index of the dielectric layer may be inversely proportional to a distance from the second substrate. The refractive index of the dielectric layer may be smaller than that of the second substrate. The plasma display panel may further include a protective layer covering the dielectric layer. The refractive index of the protective layer may be smaller than that of the dielectric layer.

According to another aspect of the present invention, a plasma display panel includes: a first substrate; a second substrate facing the first substrate; barrier ribs disposed between the first and second substrates to partition a plurality of discharge cells; address electrodes formed on the first substrate to extend in a first direction to correspond to the discharge cells; display electrodes formed on the second substrate to extend in a second direction that intersects the first direction and to correspond to the discharge cells; and a dielectric layer formed on the second substrate to cover the display electrodes, wherein the dielectric layer comprises: refracting members; and refracting grooves that are hollowed portions of the refracting members.

A refractive index of the refracting groove may be smaller than that of the refracting member.

The refracting grooves may be disposed to correspond to some of the barrier ribs.

The barrier ribs may include: first barrier ribs disposed to extend in the first direction; and second barrier ribs disposed to extend in the second direction, and the refracting grooves may be disposed to correspond to the second barrier ribs. A width of the refracting groove may be equal to or smaller than that of the first and/or second barrier ribs.

A width of a first or an upper end of the barrier rib may be smaller than that of a second or a lower end of the barrier rib. A width of the refracting groove may be equal to or smaller than that of the upper end of the barrier rib.

A height of the refracting groove may be equal to that of the refracting member.

According to another aspect of the present invention, a plasma display panel includes: a first substrate; a second substrate facing the first substrate; barrier ribs disposed between the first and second substrates to partition a plurality of discharge cells; address electrodes formed on the first substrate to extend in a first direction to correspond to the discharge cells; display electrodes formed on the second substrate to extend in a second direction that intersect the first direction and to correspond to the discharge cells; and a dielectric layer formed on the second substrate to cover the display electrodes, wherein the dielectric layer comprises: first refracting members disposed in regions corresponding to boundaries of pixels and formed according to colors of the phosphor layers; and second refracting members disposed in regions excluding the first refracting members.

A refractive index of the first refracting member may be smaller than that of the second refracting member.

A width of the first refracting member may be equal to or smaller than that of an upper end of the barrier rib.

The barrier ribs include: first barrier ribs disposed to extend in the first direction; and second barrier ribs disposed to extend in the second direction.

The second refracting members include: first material members disposed to correspond to the first barrier ribs constituting boundaries between blue and red discharge cells; and second material members disposed to correspond to the second barrier ribs. A refractive index of the first material member may be equal to that of the second material member.

The first refracting member may be formed to protrude from the second refracting member in the first substrate direction. A width of the first refracting member may be equal to or smaller than that of an upper end of the barrier rib.

The first refracting member has a semicircular or semielliptical cross section.

The barrier ribs may include: first barrier ribs disposed to extend in the first direction; and second barrier ribs disposed to extend in the second direction.

The first refracting members may include: first protruding members disposed corresponding to the first barrier ribs constituting boundaries between blue and red discharge cells; and second protruding members disposed corresponding to the second barrier ribs.

According to another aspect of the present invention, there is provided a plasma display panel comprising: a first substrate; a second substrate facing the first substrate; barrier ribs disposed between the first and second substrates to partition a plurality of discharge cells; address electrodes formed on the first substrate to extend in a first direction to correspond to the discharge cells; display electrodes formed on the second substrate to extend in a second direction that intersects the first direction and to correspond to the discharge cells; phosphor layers formed in inner portions of the discharge cells; and a filter layer disposed on an outer surface of the second substrate, wherein the filter layer includes: third refracting members disposed in regions corresponding to boundaries of pixels and formed according to colors of the phosphor layers; and fourth refracting members disposed in regions excluding the third refracting members and having refractive indexes which may be different from those of the third refracting members.

The refractive index of the fourth refracting member may be smaller than that of the third refracting member.

A width of the fourth refracting member may be equal to or smaller than that of an upper end of the barrier rib.

The barrier ribs may include: first barrier ribs disposed to extend in the first direction; and second barrier ribs disposed to extend in the second direction.

The third refracting members may include: third material members disposed corresponding to the first barrier ribs constituting boundaries between blue and red discharge cells; and fourth material members disposed corresponding to the second barrier ribs. A refractive index of the third material member may be equal to that of the fourth material member.

According to an aspect of the present invention, a panel of a plasma display includes a substrate having a first refractive index; and at least one element having a second refractive index, wherein the at least one element is disposed on the substrate to render a refractive angle of a light ray to be more normal to a surface of the substrate as the light ray propagates through the panel.

Additional aspects and/or advantages of the invention will be set forth in part in the description which follows and, in part, will be obvious from the description, or may be learned by practice of the invention.

BRIEF DESCRIPTION OF THE DRAWINGS

These and/or other aspects and advantages of the invention will become apparent and more readily appreciated from the following description of the aspects, taken in conjunction with the accompanying drawings of which.

DETAILED DESCRIPTION OF THE EMBODIMENTS

Figure 1:
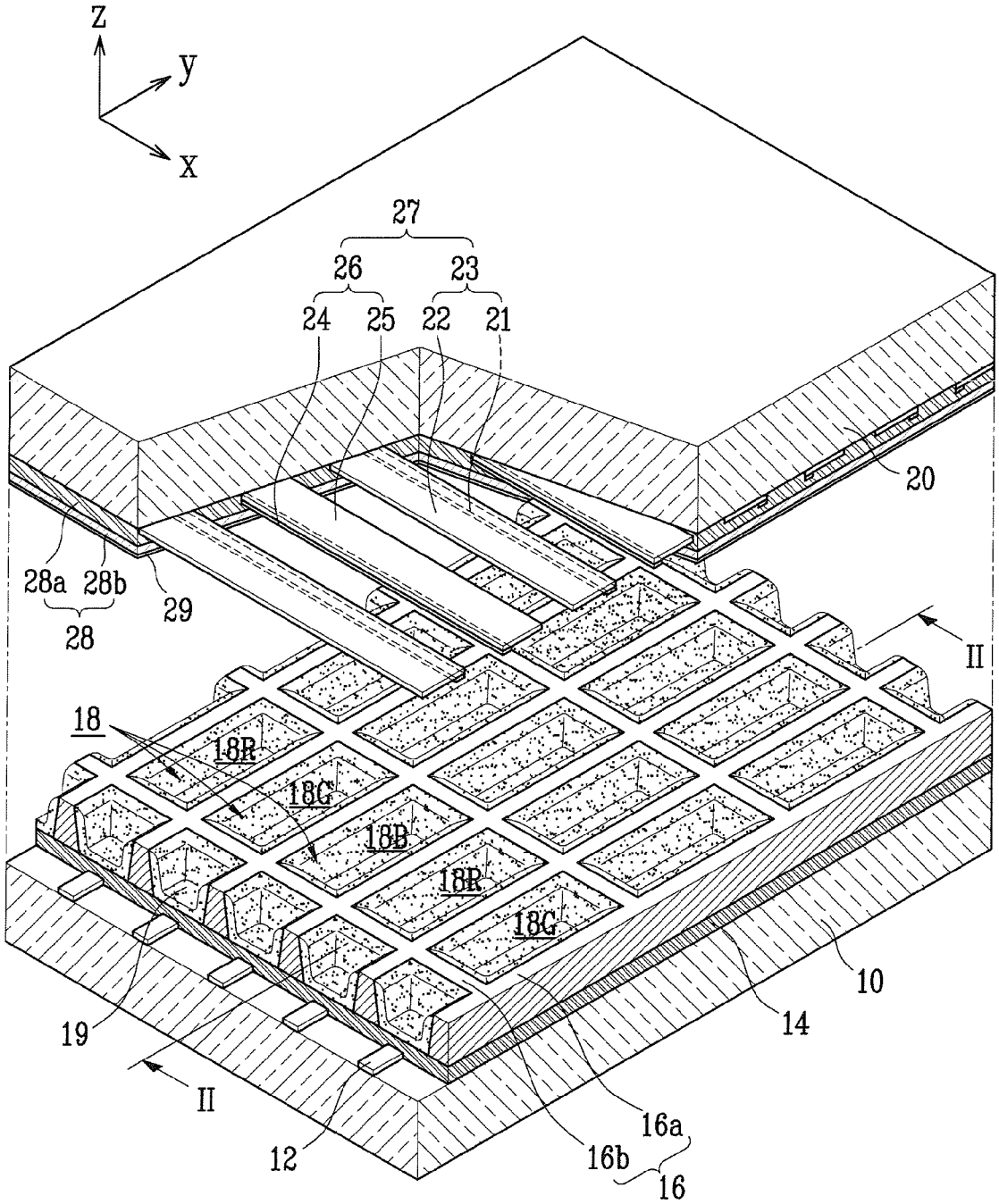
FIG. 1 is a partial cutaway perspective view showing a plasma display panel according to an aspect of the present invention.

Reference will now be made in detail to the aspects of the present invention, examples of which are illustrated in the accompanying drawings, wherein like reference numerals refer to the like elements throughout. The aspects are described below in order to explain the present invention by referring to the figures.

FIG. 1 is a partial cutaway perspective view showing a plasma display panel according to an aspect of the present invention. Referring to FIG. 1, a plasma display panel includes a first substrate 10 (hereinafter, referred to as a rear substrate), a second substrate 20 (hereinafter, referred to as a front substrate) which faces the first substrate 10 across a predetermined interval (or a space), and barrier ribs 16, which are disposed on the rear substrate 10 and within the predetermined interval (or space) between the rear and front substrates 10 and 20, to partition a plurality of discharge cells 18.

In various aspects, the barrier ribs 16 are formed by coating a dielectric material on the rear substrate 10 and performing patterning and sintering processes. The barrier ribs 16 include first barrier ribs 16*a* which extend in a first direction (y-axis direction in the figure) and second barrier ribs 16*b* which extend in a second direction (x-axis direction in the figure) that is at least substantially perpendicular to the first direction. Therefore, the first and second barriers 16*a* and 16*b* define each of the discharge cells 18, and the discharge cells 18 so partitioned (or defined) by the first and second barrier ribs 16*a* and 16*b* are arrayed in a matrix pattern.

The plasma display panel according to an aspect of the present invention is not limited thereto. That is, the discharge cells 18 partitioned by the barrier ribs 16 may be arrayed in a stripe pattern, a delta pattern, or other patterns.

As shown, address electrodes 12 are disposed on the rear substrate 10 to extend in the first direction to correspond (or relative) to the discharge cells 18. Pairs of display electrodes 27 are disposed on the front substrate 20 to extend in the second direction. Red, green, and blue phosphor layers 19 are respectively coated in inner portions of the discharge cells 18 that are arrayed parallel to the display electrodes 27 in the second direction.

As shown, inner spaces of the discharge cells 18R, 18G, and 18B, in which the red, green, and blue phosphor layers 19 are respectively formed, are filled with a discharge gas (for example, inert gases such as xenon (Xe) and/or neon (Ne)) to generate a plasma discharge.

Figure 2:
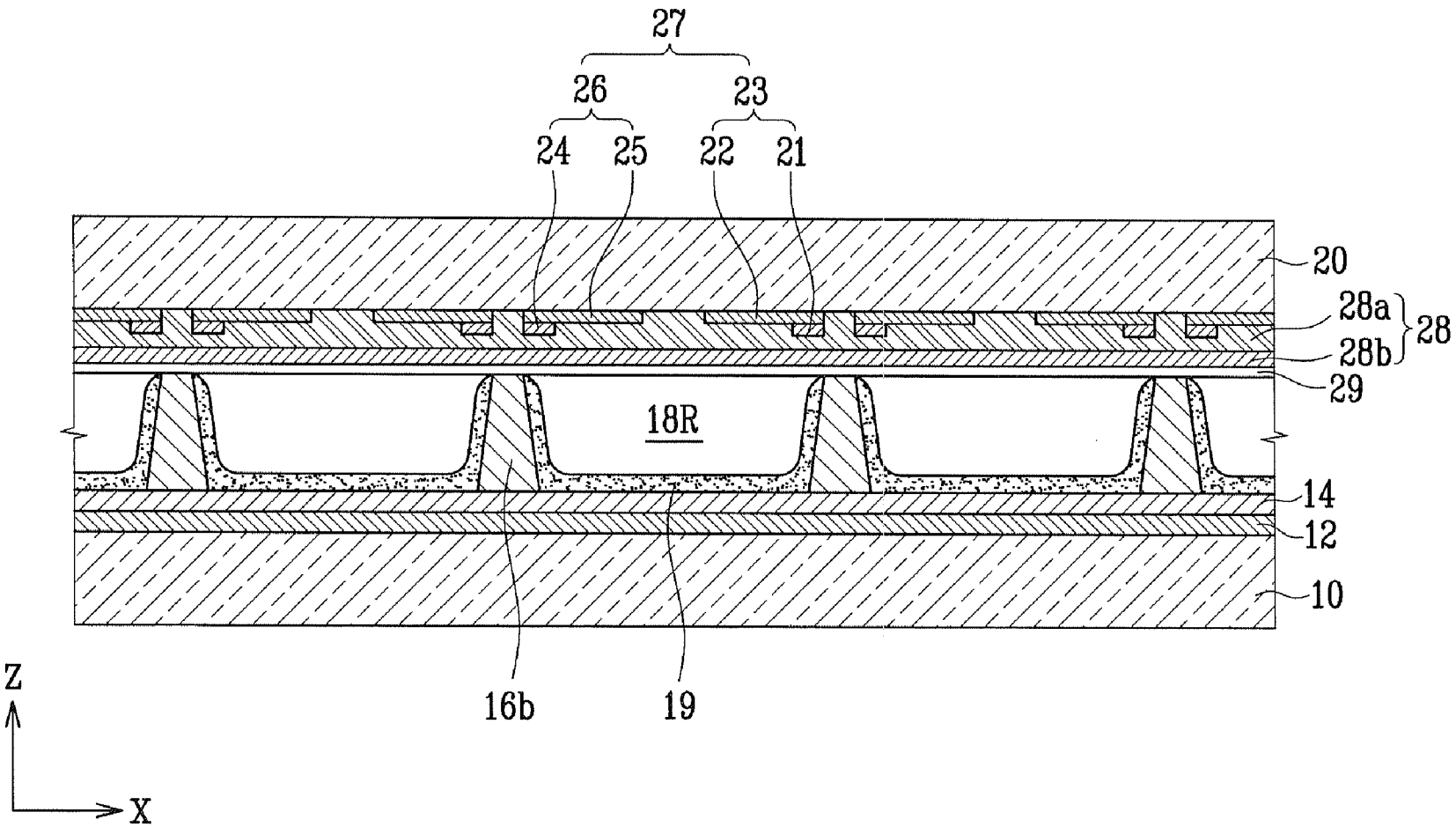
FIG. 2 is a cross-sectional view taken along line II-II of FIG. 1.

FIG. 2 is a cross-sectional view taken along line II-II of FIG. 1. Referring to FIG. 2, a lower dielectric layer 14 is formed to cover the address electrodes 12 on the rear substrate 10 to prevent damage to the address electrodes 12 by the plasma discharge and to facilitate charge storage. As shown, the display electrodes 27 include a scan electrode 23 and a sustain electrode 26 pairs, which are disposed on the inner surface of the front substrate 20. The scan and sustain electrodes 23 and 26 are formed parallel to each other in the second direction.

As shown, an upper dielectric layer 28 is disposed (or formed) to cover the scan electrodes 23 and the sustain electrodes 26. A protective layer 29 may be formed on the upper dielectric layer 28 to prevent damage to the upper dielectric layer 28 by the plasma discharge.

In various aspects, the upper dielectric layer 28 includes one or a plurality of layers having same or different refractive indexes so as to reduce an incidence angle of visible light that is incident on the front substrate 20 after the visible light generated from the discharge cell 18 passes through the upper dielectric layer 29.

In this aspect, the upper dielectric layer 28 that includes two layers having different refractive indexes is discussed. In this non-limiting aspect, the upper dielectric layer 28 includes a first dielectric layer 28*a*, which is formed on the front substrate 20 to cover the scan electrodes 23 and the sustain electrodes 26, and a second dielectric layer 28*b*, which is formed on the first dielectric layer 28*a*. In the aspect shown, the refractive indexes of the first and second dielectric layers 28*a* and 28*b* of the upper dielectric layer 28 are inversely proportional to their respective separation distances from the front substrate 20. In other words, the refractive index n2 of the first dielectric layer 28*a* that is attached to the front substrate 20 is larger than the refractive index n3 of the second dielectric layer 28*b* that is more distant from the front substrate 20 (i.e., n2>n3).

In various aspects, the refractive index of a medium is proportional to a density of the medium. Accordingly, the first dielectric layer 28*a* is made of a medium having a density that is larger than that of the second dielectric layer 28*b*. In this aspect, the refractive index n2 of the first dielectric layer 28*a* is smaller than the refractive index n1 of the first substrate 20 (n2<n1).

In a non-limiting aspect shown, the protective layer 29 is an MgO film capable of transmitting the visible light and having a high secondary electron emission coefficient so as to lower a discharge starting voltage. Other similar films are within the scope of the invention.

As shown, the scan electrode 23 includes a bus electrode 21 and a transparent electrode 22. Both the bus and transparent electrodes 21 and 22 extends along the longitudinal barrier rib 16*b*. The width of the transparent electrode 22 also extends in the second direction beyond the width of the bus electrode 21, toward the center of the discharge cell 18 (in the aspect shown, discharge cell 18R). Similarly, the sustain electrode 26 includes a bus electrode 24 and a transparent electrode 25. Both the bus electrode 24 and the transparent electrode 25 extend along the longitudinal barrier rib 16*b*. The width of the transparent electrode 25 also extends in the second direction beyond the width of the bus electrode 24, toward the center of the discharge cell 18 (in the aspect shown, discharge cell 18R). In other words, the respective transparent electrodes 22 and 25 are wider than the respective bus electrodes 21 and 24.

The respective transparent electrodes 22 and 25 are disposed on the front substrate 20 and are formed to extend in the second direction to correspond to successive red, green, and blue discharge cells 18R, 18G, and 18B. The respective transparent electrodes 22 and 25 are made of transparent and conductive materials, such as ITO (indium tin oxide) so as not to block the visible light.

Aspects of the present invention are not limited thereto. In other aspects, the transparent electrodes 22 and 25 may be formed on the bus electrodes 21 and 24 and vice versa, and/or to selectively protrude or extend from the bus electrodes 21 and 24 to correspond to the red, green, and blue discharge cells 18R, 18G, and 18B.

In a non-limiting aspect, the bus electrodes 21 and 24 are made of a highly electrically conductive and/or non-transparent material, such as metal so as to compensate (or counteract) a voltage drop occurring along the length of the transparent electrodes 22 and 25. The bus electrodes 21 and 24 may be disposed to be close to the sides of the second barrier ribs 16*b*. Accordingly, the bus electrodes 21 and 24 may be formed inbetween the discharge cells 18 so as to increase transmittance (or minimize blockage) of the visible light generated from the discharge cells 18 during the plasma discharge. In addition, the bus electrodes 21 and 24 may be disposed right along the second barrier ribs 16*b*.

During operation of the PDP, the address electrodes 12, and the scan electrode 23 and the sustain electrode 26 pairs of the display electrodes 27, of the to-be-turned-on discharge cells 18 are selected through an address discharge. Accordingly, the turned-on discharge cells 18 generate visible light to display an image through a sustain discharge of light in the discharge cells 18. The visible light generated from the discharge cells 18R, 18G, and/or 18B propagates through the protective layer 29, the second dielectric layer 28*b*, the first dielectric layer 28*a*, and the front substrate 20 to form or display an image.

Hereinafter, refraction of the visible light that is generated from the discharge cells and is propagated through the front substrate will be described.

In various aspects, when light is refracted at an interface between two isotropic media, a refractive index of each media is represented by a constant n according to Snell's law describing a relationship between an incidence angle and a refraction angle of a light beam. The refractive index denotes a degree of refraction of the light (or light beam) between the two media. The refractive index varies with a type of a material of the medium. For the same material, the refractive index is constant, although the refractive angle of the light will vary with the incidence angle of the light.

When the light is incident on an interface between two media having different refractive indexes, a reflection angle thereof increases in proportion to the difference of the reflective indexes of the two media. In addition, the reflection angle thereof also increases in proportion to the incidence angle thereof. For example, when the light is incident from a medium having a high refractive index to a medium having a low refractive index, the refraction angle is always larger than the incidence angle.

Figure 3:
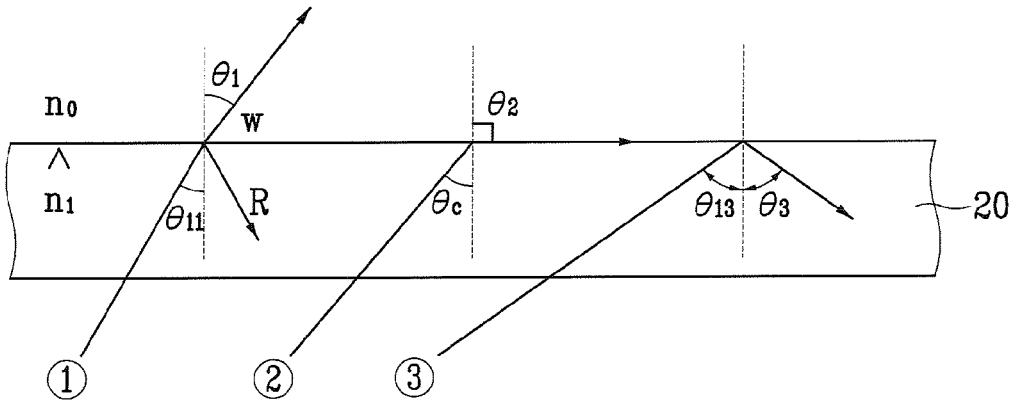
FIG. 3 is a view showing transmission through a front substrate of various visible lights that may be generated from discharge cells.

FIG. 3 is a view showing transmission through a front substrate 20 of various visible lights that may be generated from discharge cells. Referring to FIG. 3, the visible light rays that are generated from the discharge cells 18 are transmitted through the front substrate 20 according to different incidence angles as shown with rays 1, 2, and 3. Since a density of the front substrate 20 is higher than that of air, the visible light propagating from the front substrate 20 to air with a predetermined incidence angle may undergo total reflection at the interface therebetween. The incidence angle at which total reflection occurs is the critical incidence angle θc (ray 2). The critical incidence angle θc may be expressed as follows.

$$\sin 90°/\sin \theta c = n1/n0$$

$$\sin \theta c = n0/n1 \ (n1 > n0) \qquad \text{[Equation 1]}$$

Here, θc denotes the critical incidence angle for the front substrate 20, n0 denotes the refractive index of air, and n1 denotes the refractive index of the front substrate 20. As shown in Equation 1, the critical incidence angle θc is determined by a ratio of the refractive index n1 of the front substrate 20 relative to the refractive index n0 of the air.

In a non-limiting aspect, the front substrate 20 is transparent, and may be glass. The refractive index of a glass mainly used for the front substrate 20 may be 1.52, thought not required, and the refractive index of air in the standard condition is 1.00029. Therefore, the critical incidence angle θc at the interface therebetween is about 40°.

In case of the visible light (ray 1) of which an incidence angle $\theta_{11}$ is smaller than the critical incidence angle θc, a portion of the visible light (ray R) is reflected on the interface between the front substrate 20 and air, and the remaining portion of the visible light (ray W) is refracted into air by a refraction angle θ1 that is larger than the incidence angle $\theta_{11}$.

In case of the visible light (ray 2) of which an incidence angle is equal to the critical incidence angle θc, a refraction angle $\theta_2$ of the visible light (ray 2) is 90°. Accordingly, all or most of the refracted visible light is refracted along the surface of the front substrate 20.

In case of the visible light (ray 3) of which an incidence angle $\theta_{13}$ is larger than the critical incidence angle θc, a refraction angle $\theta_3$ of the visible light (ray 3) is equal to the incidence angle $\theta_{13}$, so that the visible light (ray 3) undergoes total reflection back toward the discharge cells 18.

In this manner, the visible light (2) and (3) of which the respective incidence angles are equal to or larger than the critical incidence angle θc are not transmitted through the front substrate 20 into air (i.e., toward the front of the plasma display panel). Therefore, brightness of the plasma display panel is lowered in these cases, and spreading of the visible light into the adjacent discharge cells (or halation) occurs.

As described above, in this aspect of the present invention, the upper dielectric layer 28 includes the first and second dielectric layers 28*a* and 28*b* respectively having refractive indexes of n2 and n3, which are smaller than the refractive index n1 of the first substrate 20. Additionally, the respective refractive indexes n2 and n3 are decreased in proportion to a separation distance from the front substrate 20. In other words, the refractive index of the layer that is further from the first substrate 20 is lower (n2>n3).

Due to the first and second dielectric layers 28*a* and 28*b*, the refraction angle of the visible light passing through the respective layers is gradually lowered, so that the successive incidence angle of the visible light as it approaches the front substrate 20 can be decreased.

Figure 4:
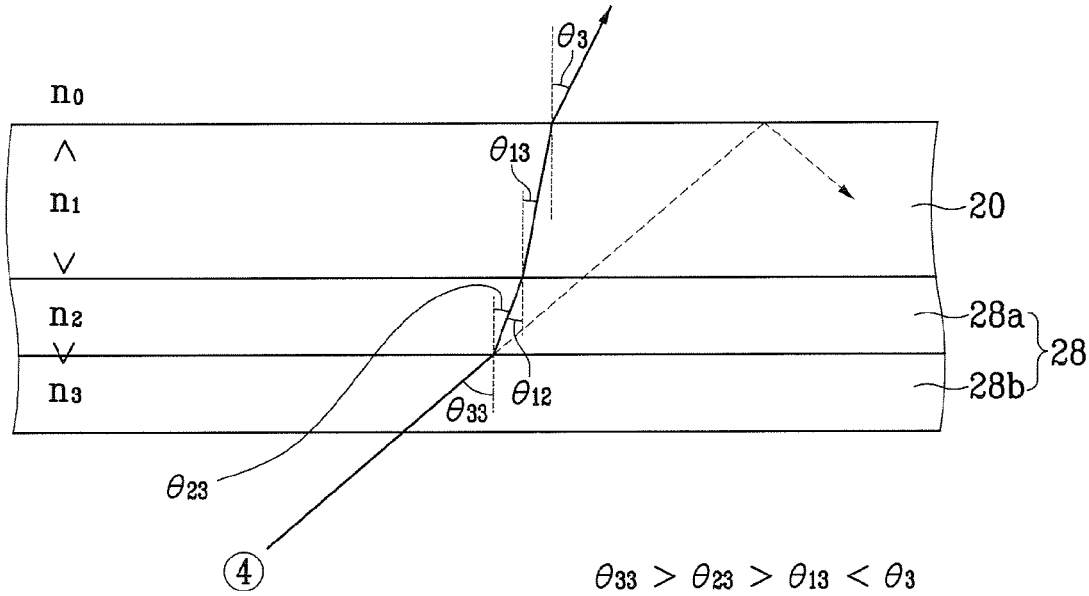
FIG. 4 is a view showing refraction and transmission of the visible light propagating through a dielectric layer and the front substrate according to aspects of the present invention.

FIG. 4 is a view showing refraction and transmission of the visible light propagating through the dielectric layer 28 and the front substrate 20 as discussed above. Referring to FIG. 4, when the visible light (ray 4) is incident from the second dielectric layer 28*b* to the first dielectric layer 28*a*, the refraction angle $\theta_{23}$ is smaller than the incidence angle $\theta_{33}$ of the visible light (ray 4). The refraction angle $\theta_{23}$ may be expressed as follows.

$$\sin\theta_{23}=(n3/n2)\sin\theta_{33}(n2>n3) \quad \text{[Equation 2]}$$

Here, $\theta_{23}$ denotes the refraction angle of the visible light (ray 4) of the interface between the first dielectric layer 28*a* and the second dielectric layer 28*b*, $\theta_{33}$ denotes the incidence angle of the visible light (ray 4) of the interface between the first dielectric layer 28*a* and the second dielectric layer 28*b*, n2 denotes the refractive index of the first dielectric layer 28*a*, and n3 denotes the refractive index of the second dielectric layer 28*b*.

Since the refractive index n3 of the second dielectric layer 28*b* is smaller than the refractive index n2 of the first dielectric layer 28*a*, the refraction angle $\theta_{23}$ of the visible light (ray 4) that is transmitted from the second dielectric layer 28*b* to the first dielectric layer 28*a* becomes smaller than the incidence angle $\theta_{33}$ of the visible light (ray 4).

In addition, the refractive index n2 of the first dielectric layer 28*a* is smaller than the refractive index n1 of the front substrate 20. Therefore, the refraction angle $\theta_{13}$ of the visible light (ray 4) that is transmitted from the second dielectric layer 28*b*, through the first dielectric layer 28*a*, to the front substrate 20 becomes smaller than the incidence angle $\theta_{12}$ at the interface between the first dielectric layer 28*a* and the front substrate 20. The refraction angle $\theta_{13}$ may be expressed as follows.

$$\sin\theta_{13}=(n2/n1)\sin\theta_{12}(n1>n2) \quad \text{[Equation 3]}$$

Here, $\theta_{13}$ denotes the refraction angle of the visible light (ray 4) of the interface between the front substrate 20 and the first dielectric layer 28*a*, $\theta_{12}$ denotes the incident angle of the visible light (ray 4) of the interface of the front substrate 20 and the first dielectric layer 28*a*, n1 denotes the refractive index of the front substrate 20, and n2 denotes the refractive index of the first dielectric layer 28*a*.

When the visible light (ray 4) that is transmitted from the second dielectric layer 28*b* through the first dielectric layer 28*a* is incident on the front substrate 20 with the incidence angle $\theta_{13}$ equal to or smaller than the critical incidence angle θc, total reflection of the visible light (ray 4) does not occur. As a result, it is possible to reduce halation of the visible light, halation being a spreading of the visible light into adjacent discharge cells 18.

In addition, the incidence angle $\theta_{12}$ of the visible light (ray 4) incident on the front substrate 20 can be equal to or smaller than the critical incidence angle θc, so that the transmittance of the visible light can be increased. As a result, brightness of the plasma display panel can be increased, and the quality of the display is improved.

In the aspect shown, the upper dielectric layer 28 includes the two layers (28*a* and 28*b*) whose refractive index decreases in proportion to their separation distance from the front substrate 20. However, the aspects of the present invention are not limited thereto. In other aspects, the upper dielectric layer 28 may include three or more layers to further increase the transmittance of the visible light, to further efficiently reduce or prevent halation, and to further improve the brightness and quality of a plasma display. In other aspects, the upper dielectric layer 28 may be a single layer.

Hereinafter, a plasma display panel according to another aspect of the present invention will be described.

Figure 5:
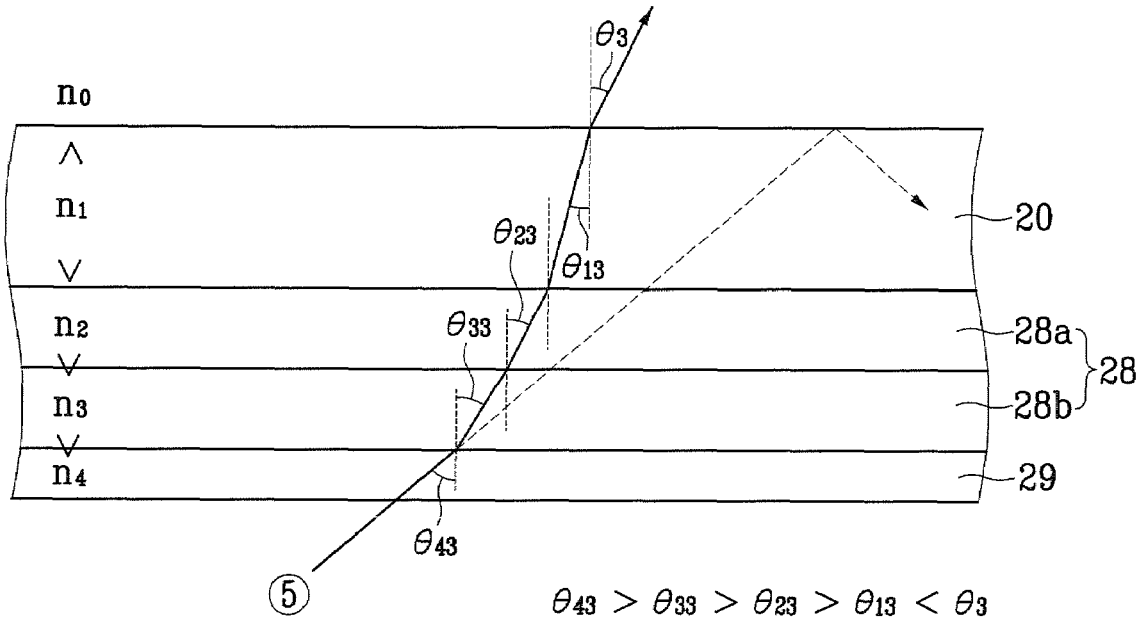
FIG. 5 is a view showing transmission of the visible light through a protective layer, a dielectric layer, and a front substrate in a plasma display panel according to an aspect of the present invention.

FIG. 5 is a view showing transmission of the visible light through a protective layer 29, a dielectric layer 28, and a front substrate 20 in a plasma display panel according to an aspect of the present invention. Referring to FIG. 5, in the plasma display panel according to an aspect of the present invention, the refractive index n4 of the protective layer 29 that covers the second dielectric layer 28*b* of the upper dielectric layer 28 is smaller than the refractive index n3 of the second dielectric layer 28*b*.

When the visible light (ray 5) is incident from the protective layer 29 having a low refractive index to the second dielectric layer 28*b* having a high refractive index, the refraction angle $\theta_{33}$ of the visible light (ray 5) become smaller than the incidence angle $\theta_{43}$ for the protective layer 20. Then, when the visible light (ray 5) that is transmitted from the protective layer 29 through the first and second dielectric layers 28*a* and 28*b* of the upper dielectric layer 28 is incident on the front substrate 20, the optical path of the visible light (ray 5) becomes more parallel to a straight line (i.e., a line that is perpendicular to the surface of the front substrate 20).

As a result, at the interface between the front substrate 20 and air, the incidence angle of the visible light (ray 5) that is transmitted from the protective layer 29, through upper dielectric layer 28, to the front substrate 20 is much smaller than the critical incidence angle θc. Accordingly, the visible light (ray 5) can be transmitted through the front substrate 20 without being totally reflected at the interface thereof as would occur as shown by the dotted arrow in the absence of the protective layer 29 and/or upper dielectric layer 28 having the low refractive index than that of the front substrate 20. According to this aspect, it is possible to more effectively prevent halation and improve the transmittance of the visible light accordingly. Therefore, the brightness of the plasma display panel can be increased, and it is possible to improve the display quality of the plasma display panel.

Figure 6:
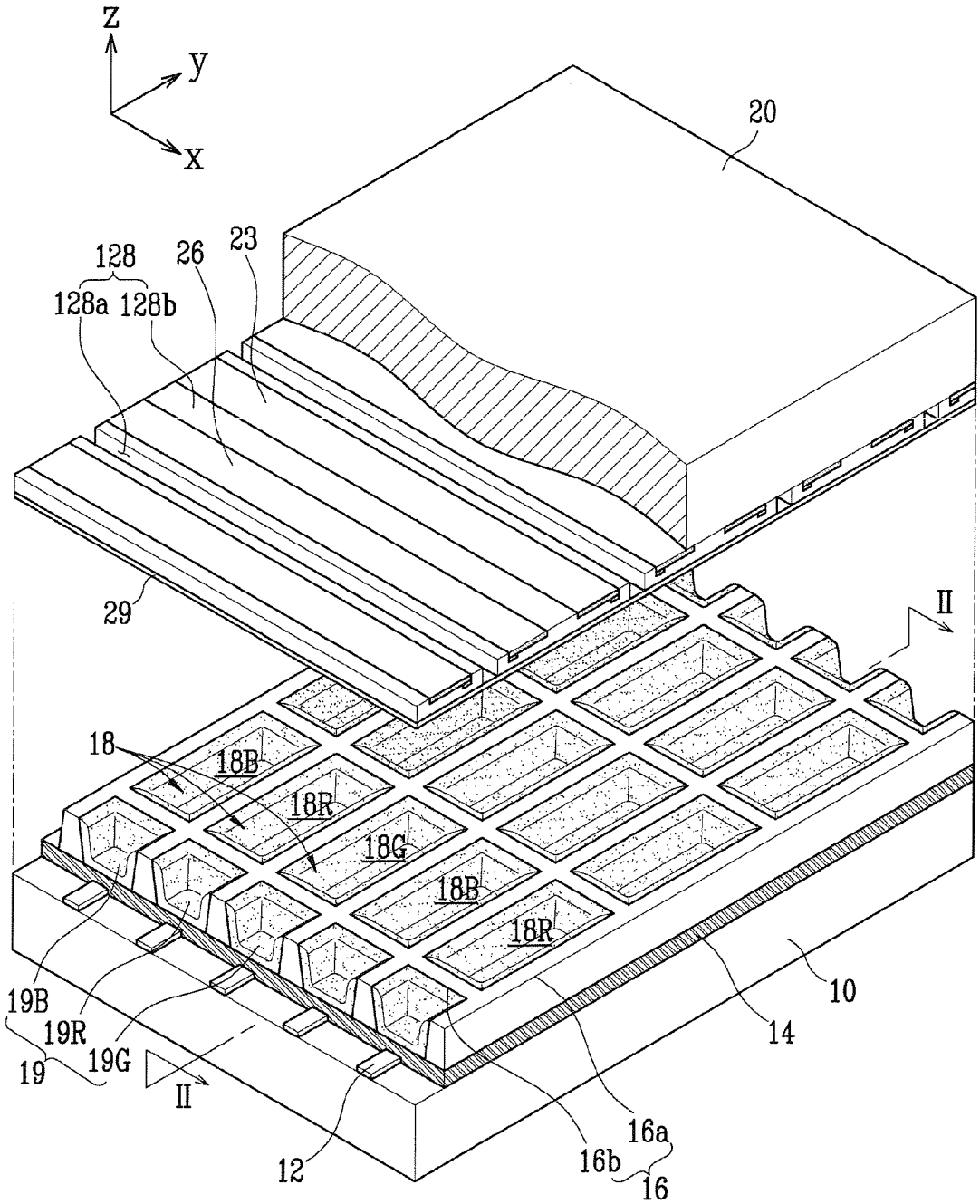
FIG. 6 is a partial cutaway perspective view showing a plasma display panel according to an aspect of the present invention.
Figure 7:
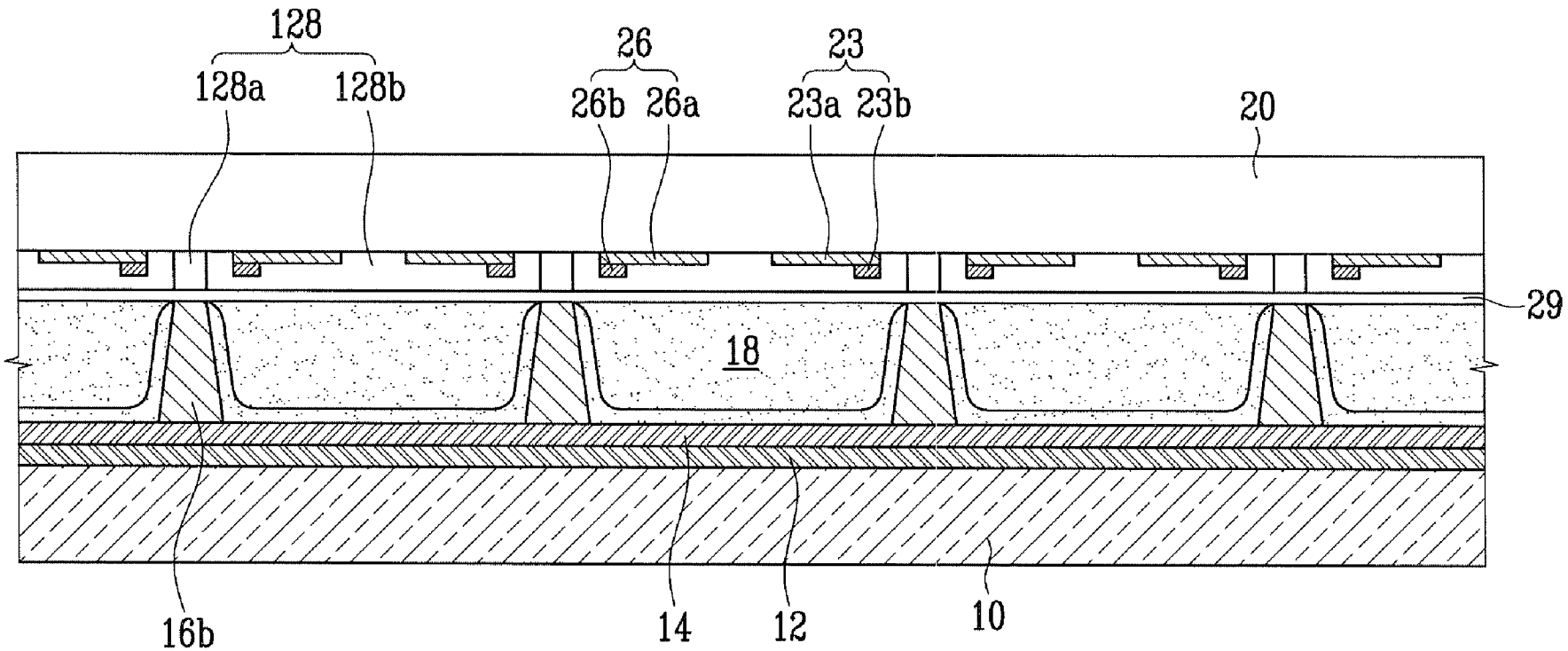
FIG. 7 is a cross-sectional view taken along line II-II of FIG. 6.

FIG. 6 is a partial cutaway perspective view showing a plasma display panel according to an aspect of the present invention. FIG. 7 is a cross-sectional view taken along line II-II of FIG. 6. As shown, the plasma display panel is described with references to FIGS. 6 and 7. For simplification of description, common elements as those of the aspects of the present invention as discussed above are not described. Rather, only differences will be mainly described.

A dielectric layer 128 according to this aspect includes refracting member or members 128*b* having a predetermined refractive index and refracting groove or grooves 128*a* formed as empty spaces (or hollows) by removing material from some portions of the refracting members 128*b*. The refractive indexes of the refracting groove 128*a* and refracting member 128*b* are different from each other.

Figure 8:
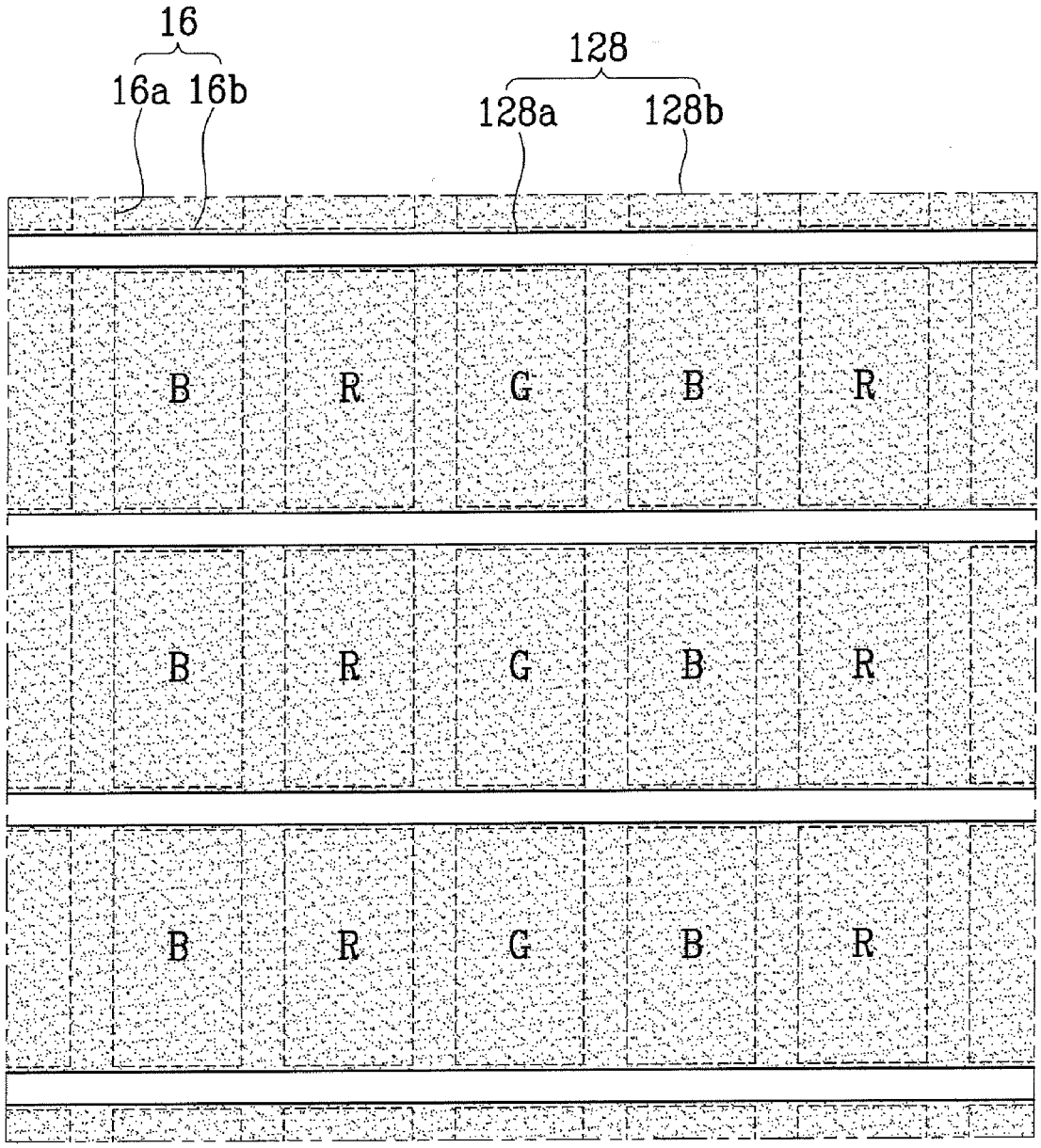
FIG. 8 is a plan view showing an arrangement of refracting grooves and refracting members of a dielectric layer of the plasma display panel according to the aspect of FIG. 6.

FIG. 8 is a plan view showing an arrangement of the refracting grooves 128*a* and the refracting members 128*b* of the dielectric layer 128 of the plasma display panel according to the aspect of FIG. 6. Referring to FIG. 8, the refracting grooves 128*a* are disposed in regions of the front substrate 20 that correspond to boundaries that separate a plurality of the discharge cells 18R, 18G, and 18B that have corresponding colors of the phosphor layers 19R, 19G, and 19B. The refracting members 128*b* are disposed in regions of the front substrate 20 that exclude the refracting grooves 128*a*.

As shown, the refracting grooves 128*a* may be disposed (or positioned) to correspond to some portions of the barrier ribs 16. In a non-limiting aspect, the refracting grooves 128*a* may be disposed (or positioned) to correspond to the second barrier ribs 16*b* that extends in the second direction. In other words, the refracting grooves 128*a* are not disposed (or positioned) to correspond to all of the barrier ribs 16. Rather, by accounting for interference (or blockage) due to all or portions of the display electrodes (such as shown in FIGS. 1 and 2), the refracting grooves 128*a* may be disposed to correspond to only the second barrier ribs 16*b*. As shown, the refracting grooves 128*a* extend in the second direction and are periodically repeated in the first direction. In various aspects, the refracting grooves 128*a* may be disposed or positioned directly on portions of the front substrate 20, though not required.

Although not required, if the refracting grooves 128*a* are also disposed to correspond to the first barrier ribs 16*a*, the refracting grooves may interfere with the sustain electrodes 26 and the scan electrodes 23 constituting the display electrodes. Specifically, the scan electrodes 23 and the sustain electrodes 26 will be exposed at intersections of these electrodes and the first barrier ribs 16*a*. Therefore, it is preferable, but not required, that the refracting grooves 128*a* are not disposed to correspond to the first barrier ribs 16*a*. In other aspects, if the refracting grooves 128*a* are to be disposed to correspond to the first barrier ribs 16*a*, the refracting groove 128*a* can be disposed (or positioned) to correspond to the remaining regions that exclude the regions (or portions) where the sustain electrodes 26 and the scan electrodes 23 are disposed.

Figure 9:
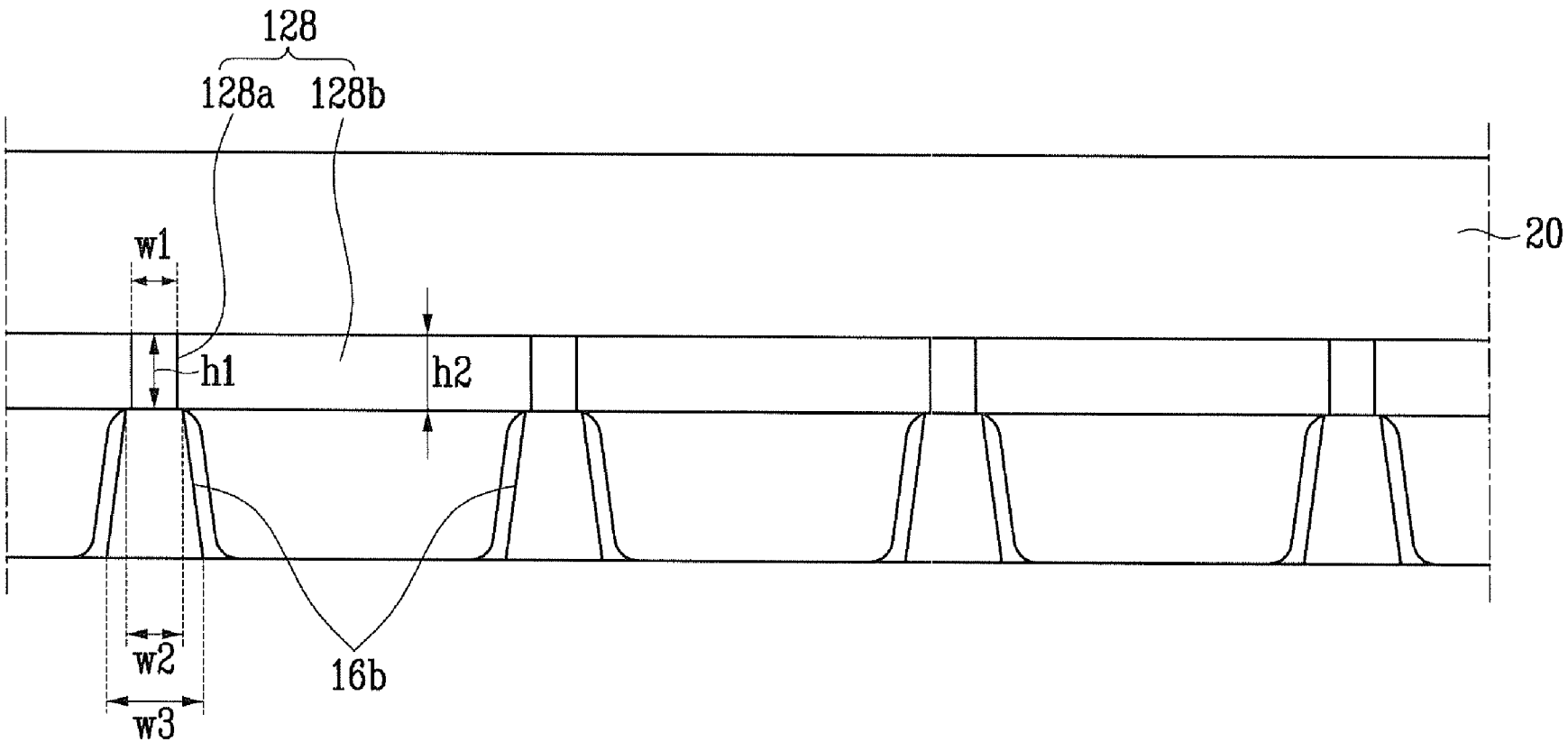
FIG. 9 is a cross-sectional view showing the dielectric layer and barrier ribs of the plasma display panel according to the aspect of FIG. 6.

FIG. 9 is a cross-sectional view showing the dielectric layer and barrier ribs of the plasma display panel according to the aspect of FIG. 6. As shown, widths of upper (or first) and lower (or second) ends of the barrier ribs may be different from each other. For example, as shown in FIG. 9, the second barrier rib 16*b* may has a trapezoid shape, so that the width W2 of one end (referred to as the upper end) of the second barrier rib 16*b* is smaller than the width W3 of another end (referred to as the lower end) thereof. In addition, the first barrier rib 16*a* may also have the same shape as the second barrier rib 16*b*. In various aspects, the inclination of the side of the first and/or second barrier ribs 16*a* and 16*b* may vary. Also, in other aspects, other shapes of the first and/or second barrier ribs 16*a* and 16*b* are possible. For example, the shapes thereof may be triangular, rectangular, and/or similar shapes. Also, the shape of the sides of the first and/or second barrier ribs 16*a* and 16*b* may be curved, straight, something similar, or any combinations thereof.

In a non-limiting aspect shown, the width W1 of the refracting groove 128*a* may be equal to or smaller than the width W2 of the second barrier rib 16*b*. In addition, the height h1 of the refracting groove 128*a* may be equal to the height h2 of the refracting member 128*b*. In other aspects, the width W1 of the refracting groove 128*a* may be greater than the width W2 of the second barrier rib 16*b*, and/or the height h1 of the refracting groove 128*a* may not be equal to the height h2 of the refracting member 128*b*.

Figure 10:
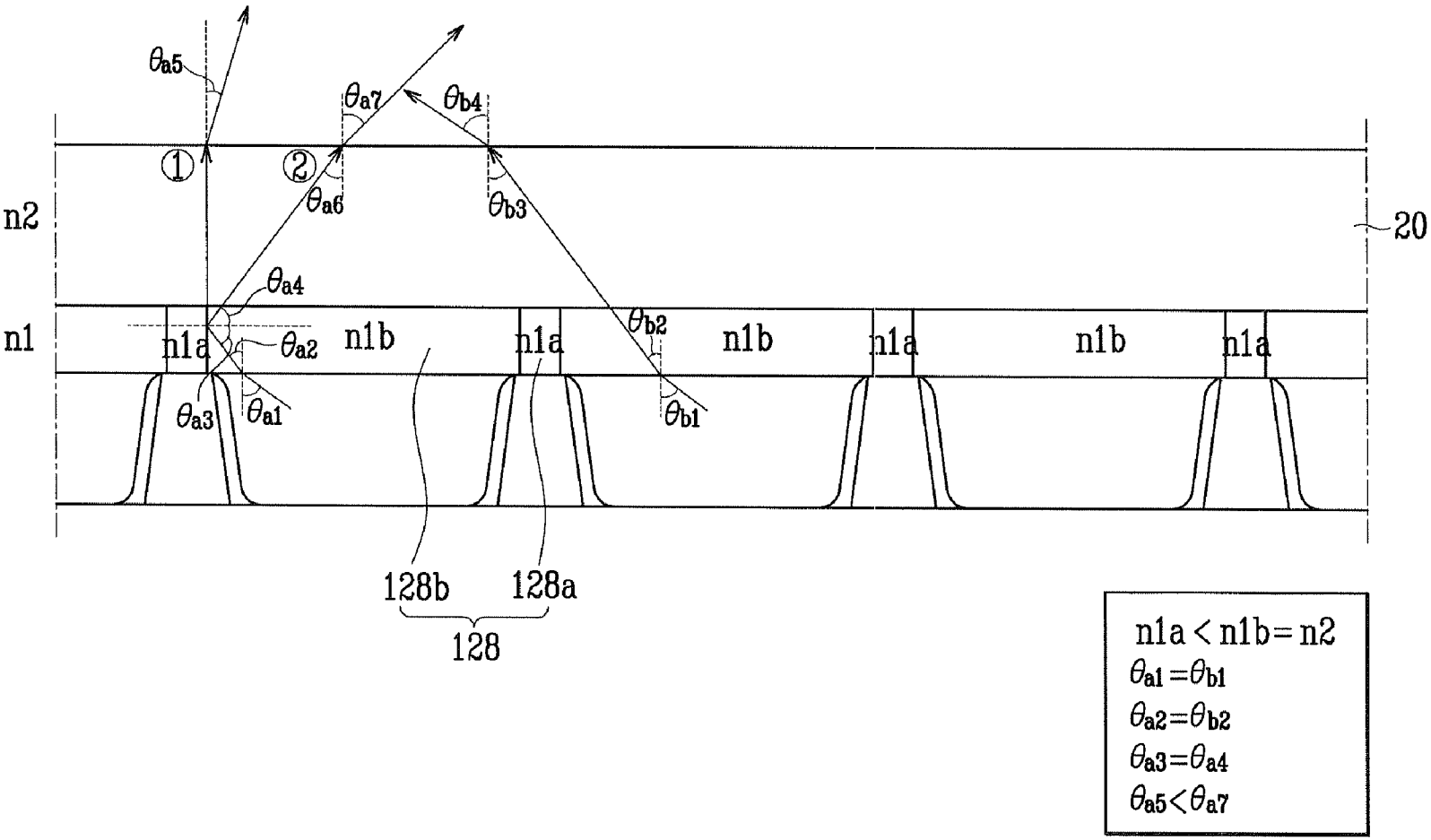
FIG. 10 is a view showing refractive indexes of the dielectric layer and the front substrate with respect to visible light in the plasma display panel according to the aspect of FIG. 6.

FIG. 10 is a view showing refractive indexes of the dielectric layer and the front substrate with respect to visible light in the plasma display panel according to the aspect of FIG. 6.

In the non-limiting aspect shown in FIG. 10, the refracting groove 128*a* is an empty space (or a hollow) formed by removing portions of the dielectric material of the dielectric member 128. Accordingly, refractive index of the refracting groove 128*a* is smaller than the refractive index of the refracting member 128*b*. In other words, a relationship between a refractive index n1*a* of the refracting groove 128*a* and a refractive index n1*b* of the refracting member 128*b* is as n1*a*<n1*b* (i.e., the refractive index n1*a* of the refracting groove 128*a* is smaller than the refractive index n1*b* of the refracting member 128*b*).

In addition, the refracting groove 128*a* may be filled with a discharge gas. In this case also, the refractive index n1*a* of the refracting groove 128*a* is smaller than the refractive index n1*b* of the refracting member 128*b*. In various aspects, the discharge gas of the refracting groove 128*a* may be the same as or different from the discharge gas used for the discharge cells 18. In various aspects, some or more of the refracting grooves 128*a* may be fluid connected to or sealed off from the discharge cells 18.

When the refracting groove 128*a* is present, and if the respective incidence angles of the visible light rays from the same discharge cell 18 that are incident on the refracting groove 128*a* and the refracting member 128*b* are equal to each other, the refraction angle of the visible light ray for the refracting groove 128*a* having the smaller refractive index is larger than the refraction angle of the visible light ray for the refracting member 128*b*.

On the other hand, the visible light rays generated from the different discharge cells 18 will often be incident on the dielectric layer 128 with different incidence angles from those of visible rays generated from the same discharge cells 18.

In the non-limiting aspect shown in FIG. 10, when the incidence angles θa1 and θb1 of the visible light rays from the different discharge cells 18 to the refracting member 128*b* are equal to each other, the refraction angles θa2 and θb2 for the refracting member 128*b* are also equal to each other.

With respect to any visible light that attempts to pass through both the refracting groove 128*a* and the refracting member 128*b* that constitute the dielectric layer 128, the refracting member 128*b* having the larger refractive index and the refracting groove 128*a* having the smaller refractive index will cause the critical incidence angle θa3 of the visible light at the interface therebetween. Accordingly, possibility of a total reflection of the visible light occurs. As discussed above, the critical incidence angle θa3 is determined by a ratio of the refractive index n1*b* of the refracting member 128*b* relative to the refractive index n1*a* of the refracting groove 128*a*.

In case of the visible light of which incidence angle is smaller than the critical incidence angle θa3, a portion of the visible light is reflected at the interface between the refracting groove 128*a* and the refracting member 128*b*, and the remaining portion of the visible light is refracted by the refraction angle larger than the incidence angle to be transmitted through the refracting groove 128*a*.

In the case of the visible light of which the incidence angle is equal to the critical incidence angle θa3, the refraction angle of the visible light is 90° at the interface between refracting groove 128*a* and the refracting member 128*b* (see visible light ray 1). In this case, the refraction angle θa5 of the visible light that is transmitted through the front substrate 20 to air is larger than the incidence angle of 0° at the interface between the front substrate 20 and air. This is because the refractive index n2 of the front substrate 20 is larger than that of air.

In the case of the visible light of which the incidence angle is larger than the critical incidence angle θa3, the reflection angle θa4 of the visible light is equal to the incidence angle, so that the visible light undergoes total reflection toward the first substrate 20 (or a field of view of the discharge cells) at the interface between the refracting groove 128*a* and the refracting member 128*b* (visible light ray 2). In this case, the refraction angle θa7 of the visible light that is transmitted from the front substrate 20 to air is larger than the incidence angle θa6. Again, this is because the refractive index n2 of the front substrate 20 is larger than that of air As a result, at the above noted interface, a visible light having an incidence angle that is equal to or larger than the critical incidence angle θa3 is not transmitted through the refracting groove 128*a*, so that the spreading of the visible light into the adjacent discharge cells (or the field of view thereof) can be reduced or prevented.

Therefore, in this aspect of the present invention, if the visible light rays collect toward the edges of the discharge cells, total reflection thereof can efficiently occur at the refracting grooves 128*a*. In addition, if the incidence angle (or critical incidence angle) of the visible light that is incident on the refracting grooves 128*a* is designed to be as large as possible, total reflection thereof can occur effectively (or efficiently). For this reason, a difference between the refractive indexes n1*a* and n1*b* of the refracting grooves 128*a* and the refracting member 128*b* may be designed to be as large as possible, though not required.

Although not required, in another aspect of the present invention, the refractive indexes n2 of the front substrate 20 and the refractive index n1*b* of the refracting member 128*b* may be equal to each other.

The above aspect of the present invention is described with reference to specific aspects, but various modifications thereof can be made without departing from the scope of the aspects of the present invention.

For example, the refractive index n1 of the dielectric layer 128 may be smaller than the refractive index n2 of the front substrate 20. In this case, since the visible light is incident from the dielectric layer 128 having the smaller refractive index to the front substrate 20 having the larger refractive index, the refraction angle of the visible light becomes smaller than the incidence angle thereof.

That is, in this case, when the visible light is transmitted through the dielectric layer 128 to the front substrate 20, the refraction angle thereof becomes smaller than the incidence angle thereof, so that the optical path of the visible light becomes (or is rendered) closer to a straight line. As a result, the transmittance of the visible light can be increased. In other words, when the visible light is transmitted successively from a medium having a small (or low) refractive index to a medium having a large (or high) refractive index, the refraction angles thereof can be gradually lowered (or decreased) until finally, the optical path of the visible light becomes (or is rendered) closer (or close) to a straight line. In various non-limiting aspects, becoming closer to a straight line refers to becoming more normal to the respective interfaces.

Hereinafter, redundant description of the same elements as those of the aforementioned aspects will be omitted.

Figure 11:
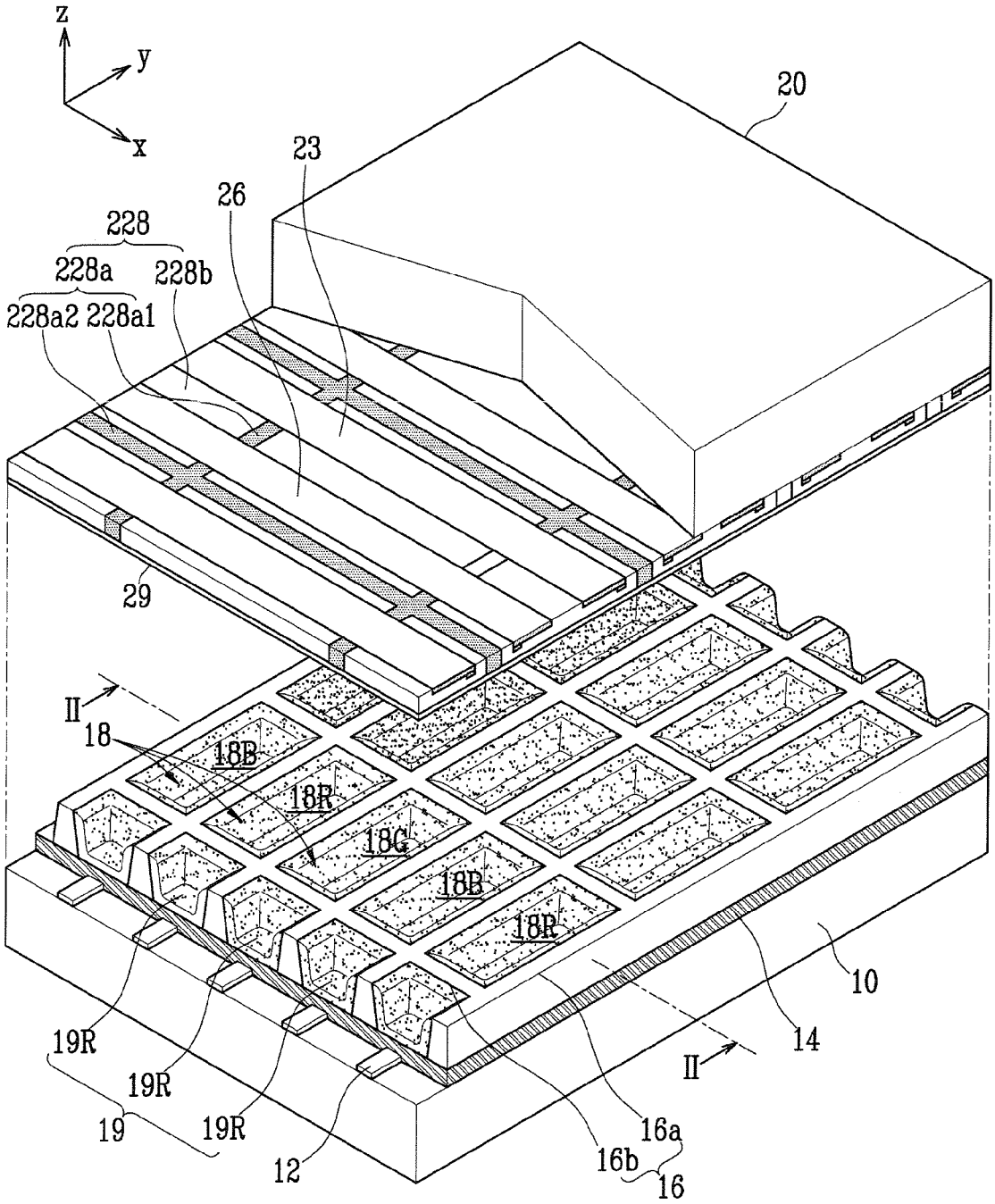
FIG. 11 is a partial cutaway perspective view showing a plasma display panel according to another aspect of the present invention.
Figure 12:
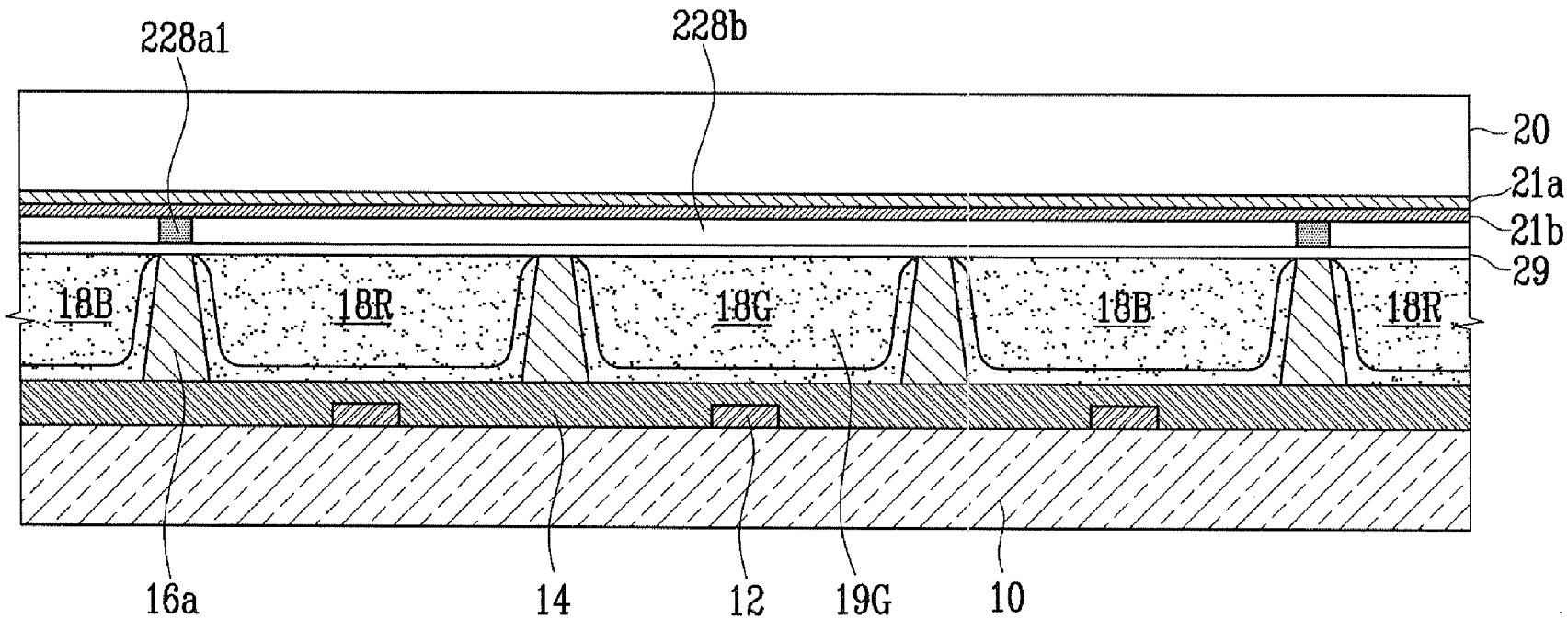
FIG. 12 is a cross-sectional view taken along line II-II of FIG. 11.
Figure 13:
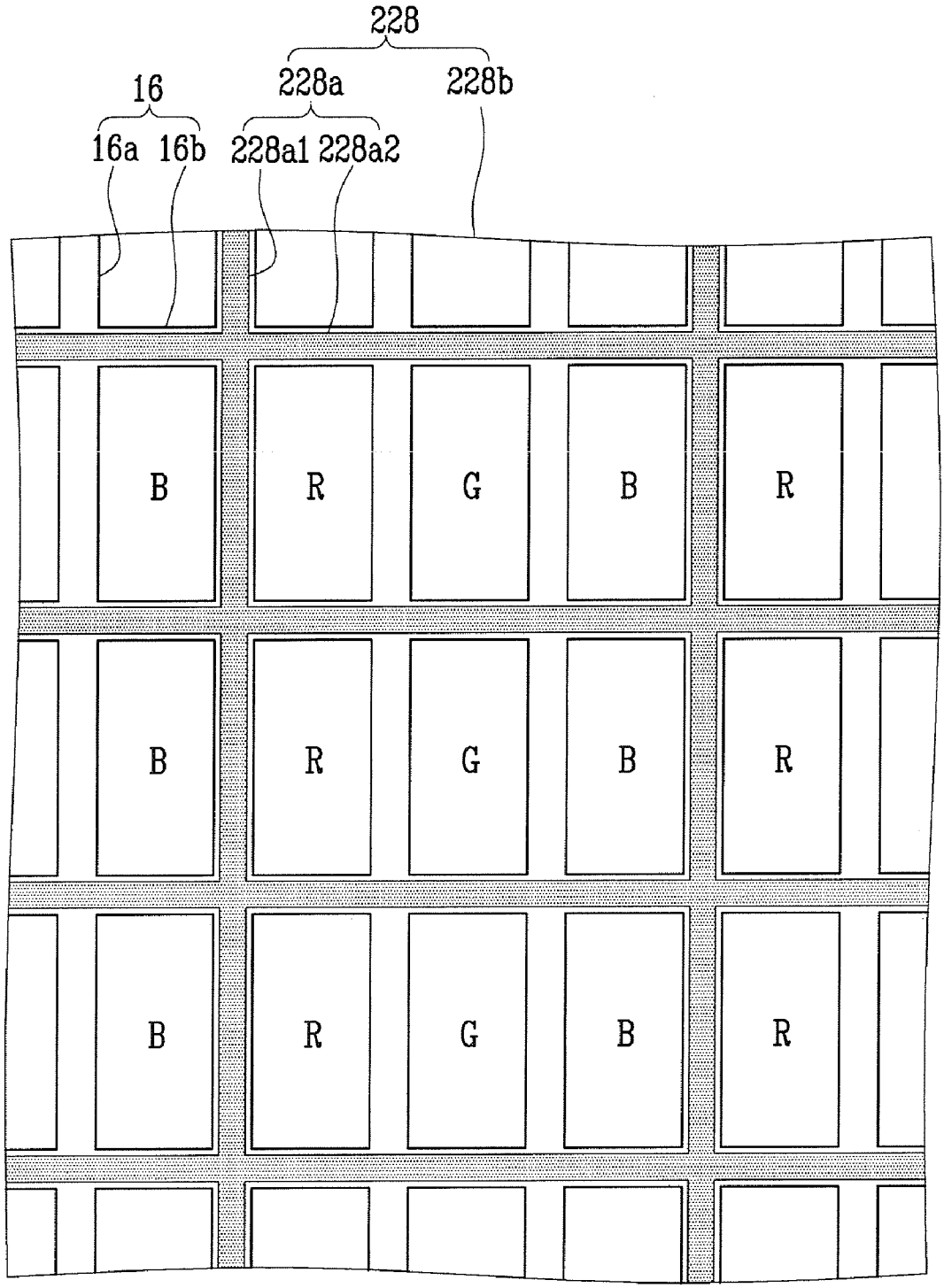
FIG. 13 is a plan view showing an arrangement of first refracting members and second refracting members of a dielectric layer of the plasma display panel according to the aspect of FIG. 11.

FIG. 11 is a partial cutaway perspective view showing a plasma display panel according to another aspect of the present invention. FIG. 12 is a cross-sectional view taken along line II-II of FIG. 11. FIG. 13 is a plan view showing an arrangement of first refracting members and second refracting members of a dielectric layer of the plasma display panel according to the aspect of FIG. 11.

Firstly, the plasma display panel according to this aspect will be described with references to FIGS. 11 to 13.

As shown, a dielectric layer 228 includes first refracting member or members 228*a* and second refracting member or members 228*b* that have different refractive indexes. The first refracting members 228*a* are disposed in regions of the front substrate 20 that correspond to boundaries of pixels and are formed according to corresponding colors of phosphor layers 19R, 19G, and 19B. The second refracting members 228*b* are disposed in regions of the front substrate 20 that exclude the first refracting members 228*a*.

As shown, the first refracting members 228*a* include first material member or members 228*a*1 and second material member or members 228*a*2. The first material members 228*a*1 are disposed in regions of the front substrate 20 that correspond to the boundaries between the blue and red discharge cells 18B and 18R among the regions of the front substrate 20 that correspond to the first barrier ribs 16*a*. In other words, the first material members 228*a*1 are not disposed in all of the regions of the front substrate 20 that correspond to the first barrier ribs 16*a*. Rather, the first material members 228*a*1 are disposed in only the regions of the front substrate 20 that correspond to portions for partitioning the pixels. Therefore, the first material members 228*a*1 are not disposed in the regions of the front substrate 20 that correspond to the boundaries between the red and green discharge cells 18R and 19G and the boundaries between the green and blue discharge cells 18G and 18B among the regions of the front substrate 20 that correspond to the first barrier ribs 16*a*. The first material members 228*a*1 are repeated in the second direction (the horizontal direction of FIG. 13).

On the other hand, the second material members 228*a*2 are disposed in the second direction in all of the regions of the front substrate 20 that correspond to the second barrier ribs 16*b*. The second material members 228*a*2 are repeated in the first direction (the vertical direction of FIG. 13).

Figure 14:
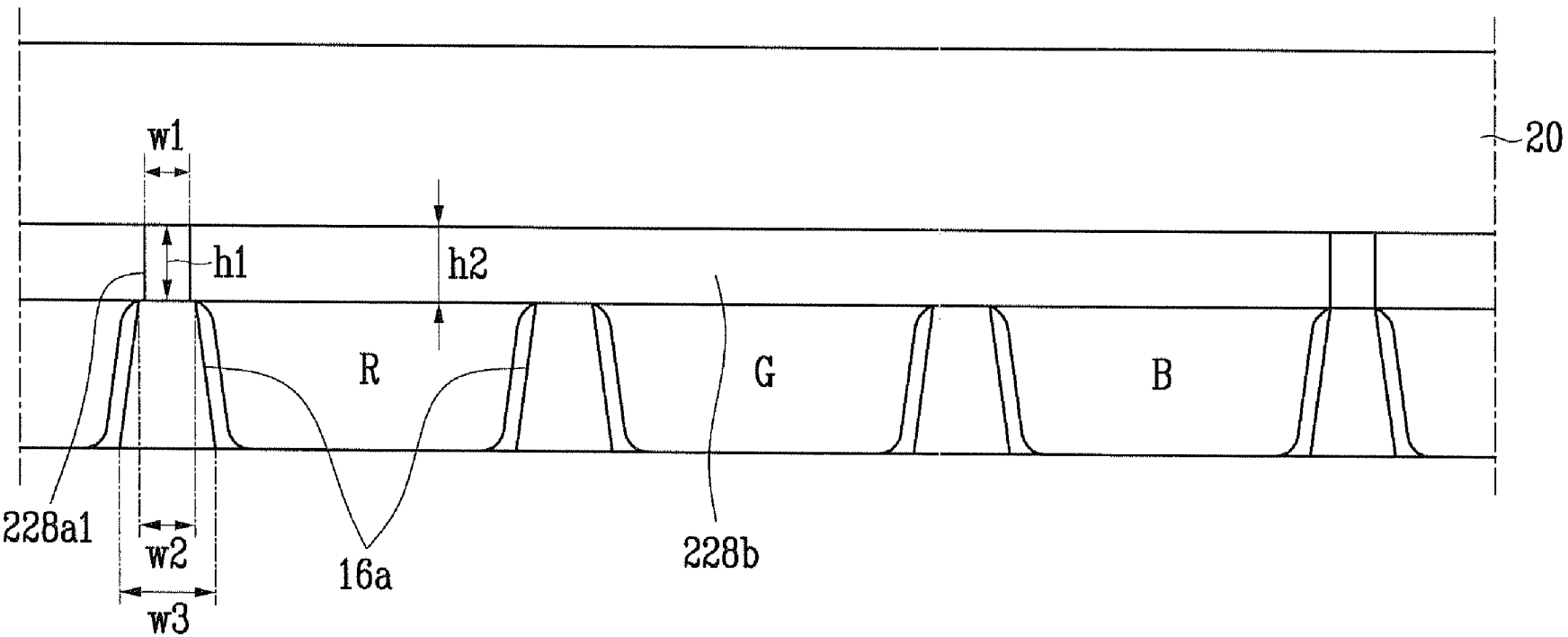
FIG. 14 is a cross-sectional view showing the dielectric layer and barrier ribs of the plasma display panel according to the aspect of FIG. 11.

FIG. 14 is a cross-sectional view showing the dielectric layer and barrier ribs of the plasma display panel according to the aspect of FIG. 11.

As shown, widths of upper (or a first) and lower (or a second) ends of the barrier ribs may be different from each other. For example, as shown in FIG. 14, the first barrier rib 16*a* may have a trapezoid shape, so that the width W2 of the upper end of the first barrier rib 16*a* is smaller than the width W3 of the lower end thereof. In addition, the second barrier rib 16*b* may also have the same shape as the first barrier rib 16*a*. In various aspects, the inclination of the side of the first and/or second barrier ribs 16*a* and 16*b* may vary. Also, in other aspects, other shapes of the first and/or second barrier ribs 16*a* and 16*b* are possible. For example, the shapes thereof may be triangular, rectangular, and/or similar shapes. Also, the shape of the sides of the first and/or second barrier ribs 16*a* and 16*b* may be curved, straight, something similar, or any combinations thereof. In a non-limiting aspect, the width W1 of the first refracting member 228*a* may be equal to or smaller than the width W2 of the first barrier rib 16*a*. In addition, the height h1 of the first refracting member 228*a* may be equal to the height h2 of the second refracting member 228*b*. In other aspects, the width W1 of the first refracting member 228*a* may be greater than the width W2 of the second barrier rib 16*b*, and/or the height h1 of the first refracting member 228*a* may not be equal to the height h2 of the second refracting member 228*b*

Figure 15:
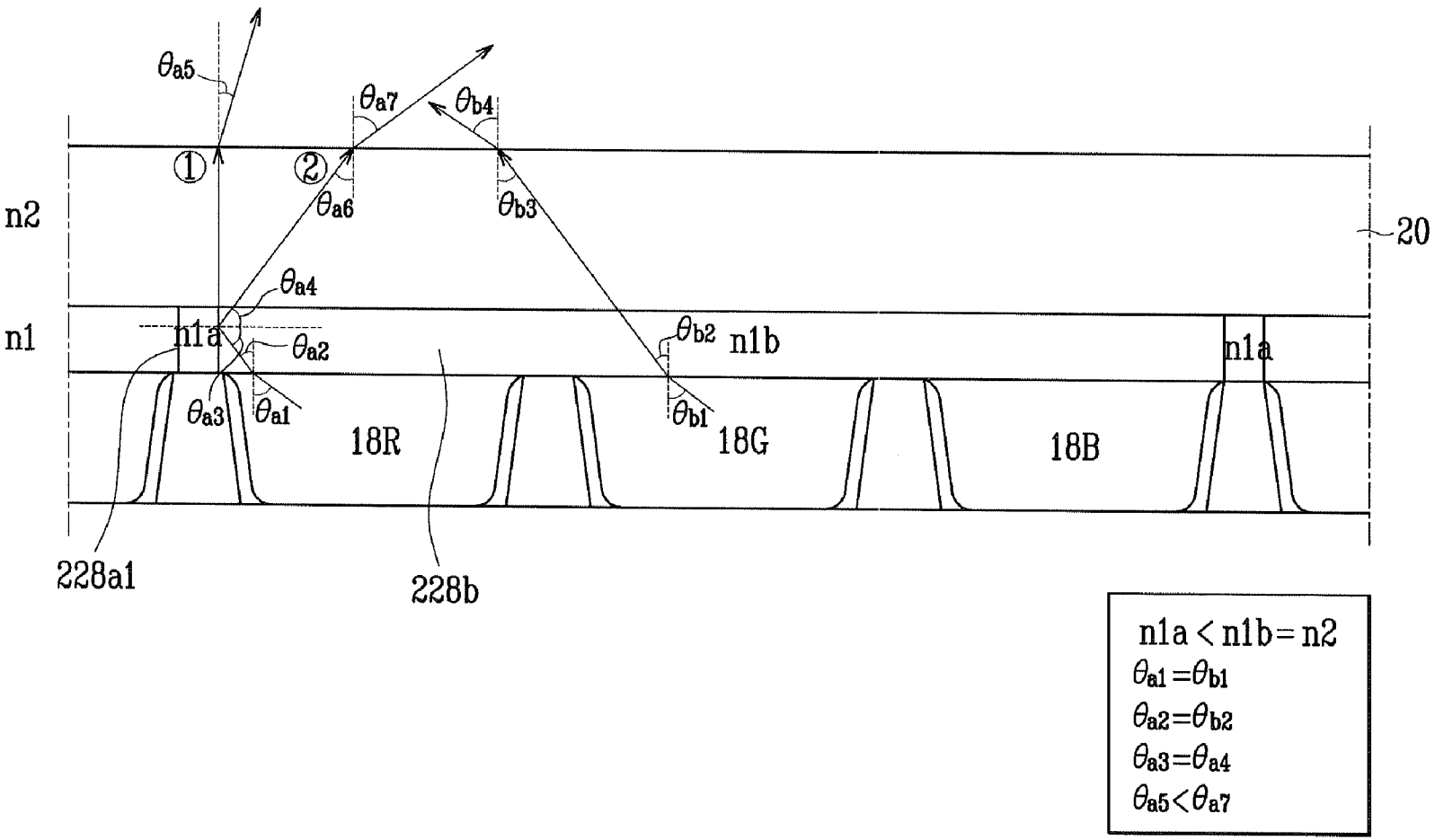
FIG. 15 is a view showing refractive indexes of the dielectric layer and the front substrate with respect to visible light in the plasma display panel according to the aspect of FIG. 11.

FIG. 15 a view showing refractive indexes of the dielectric layer and the front substrate 20 with respect to visible light in the plasma display panel according to the aspect of FIG. 11. As shown, the refractive index n1*a* of the first refracting member 228*a* is smaller than the refractive index n1*b* of the second refracting member 228*b*. In other words, a relationship between the refractive index n1*a* of the first refracting member 228*a* and the refractive index n1*b* of the second refracting member 228*b*is n1*a*<n1*b*. In such a case, when the incidence angles of the various visible light rays that are incident on the first and second refracting members 228*a* and 228*b* are equal to each other, the refraction angle of the visible ray that is incident on the first refracting member 228*a* having the smaller refractive index is larger than the refraction angle of the second refracting member 228*b* having the larger refractive index. In addition, in non-limiting aspects, the first and second material members 228*a*1 and 228*a*2 that constitute the first refracting member 228*a* may have the same refractive index.

On the other hand, the visible light rays generated from the different pixels (or discharge cells 18) will often be incident on the dielectric layer 228 with different incidence angles from those of visible rays generated from the same pixels or discharge cells 18.

In the non-limiting aspect shown in FIG. 15, when the incidence angle θa1 of the visible light ray that is incident from the red discharge cell 18R to the second refracting member 228*b* is equal to the incidence angle θb1 of the visible light ray that is incident from the green discharge cells 18G to the second refracting member 228*b*, the refraction angles θa2 and θb2 of the visible light rays refracted by the second refracting member 228*b* are also equal to each other.

With respect to any visible light that attempts to pass through both the first refracting member 228*a* and the second refracting member 228*b*, the second refracting member 228*b* that has the larger refractive index relative to the first refracting member 228*a* that has the smaller refractive index will cause a critical incidence angle θa3 of the visible light at the interface therebetween. Accordingly, possibility of a total reflection of the visible light occurs. As discussed above, the critical incidence angle θa3 is determined by a ratio of the refractive index n1*b* of the second refracting member 228*b* relative to the refractive index n1*a* of the first refracting member 228*a*.

In case of the visible light of which incidence angle is smaller than the critical incidence angle θa3, a portion of the visible light is reflected at the interface between the first refracting member 228*a* and the second refracting member 228*b*, and the remaining portion of the visible light is refracted by the refraction angle larger than the incidence angle to be transmitted through the first refracting member 228*a*.

In the case of the visible light of which the incidence angle is equal to the critical incidence angle θa3, the refraction angle of the visible light is 90° at the interface between the first refracting member 228*a* and the second refracting member 228*b* (visible light ray 1). In this case, the refraction angle θa5 of the visible light that is transmitted through the front substrate 20 to air is larger than the incidence angle of 0° at the interface between the front substrate 20 and air. This is because the refractive index n2 of the front substrate 20 is larger than that of air.

In case of the visible light of which the incidence angle is larger than the critical incidence angle θa3, the reflection angle θa4 of the visible light is equal to the incidence angle, so that the visible light undergoes total reflection toward air, but inside the field of view of the pixels (visible light ray 2). In this case, the refraction angle θa7 of the visible light that is transmitted from the front substrate 20 to air is larger than the incidence angle θa6. Again, this is because the refractive index n2 of the front substrate 20 is larger than that of air.

As a result, a visible light having an incidence angle that is equal to or larger than the critical incidence angle θa3 is not transmitted through the first refracting member 228*a*, so that the spreading of the visible light into the discharge cells (or field thereof of the adjacent pixels can be reduced or prevented.

In the following, redundant description of the same elements as those of the aforementioned aspects will be omitted.

Figure 16:
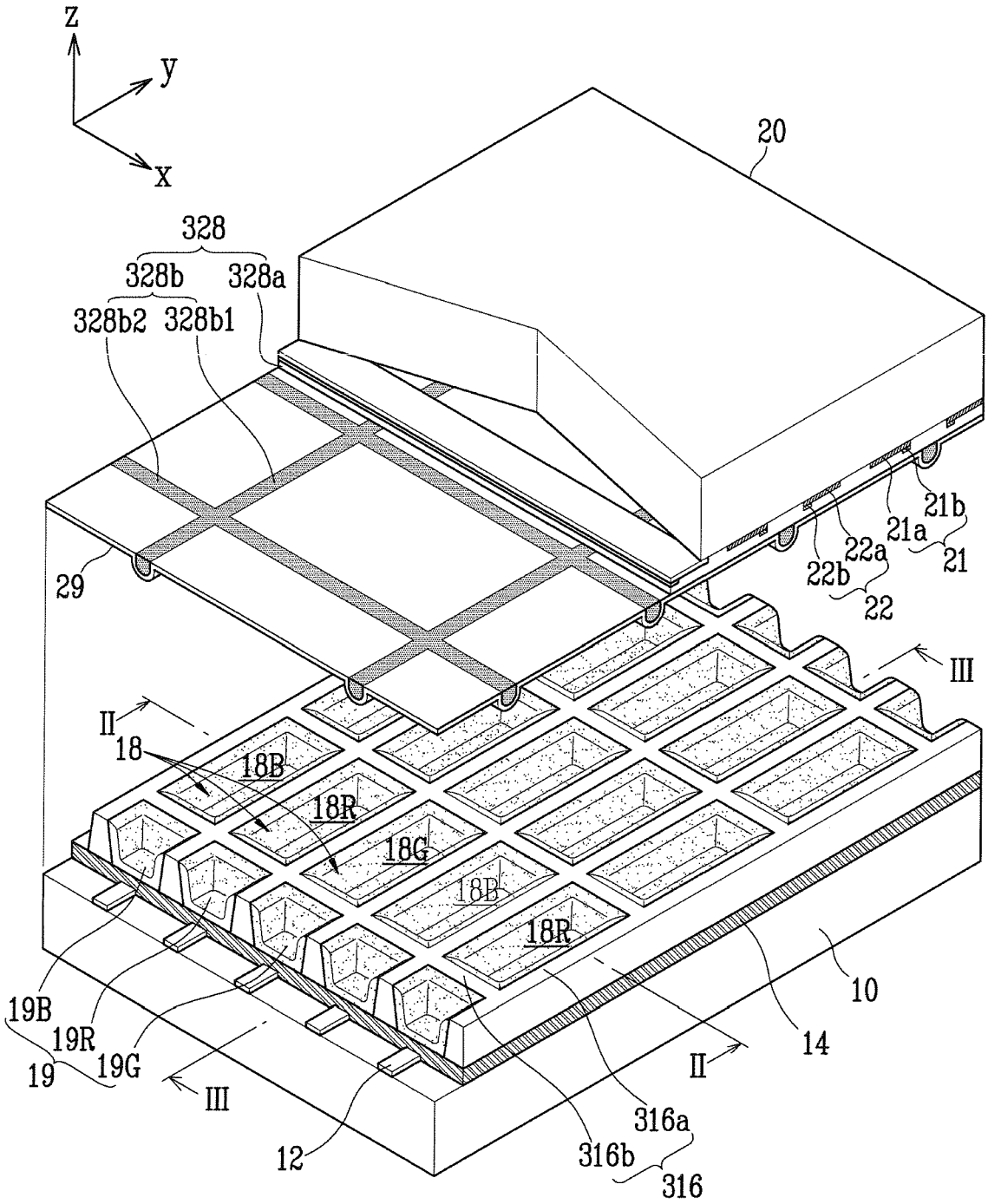
FIG. 16 is a partial cutaway perspective view showing a plasma display panel according to an aspect of the present invention.
Figure 17:
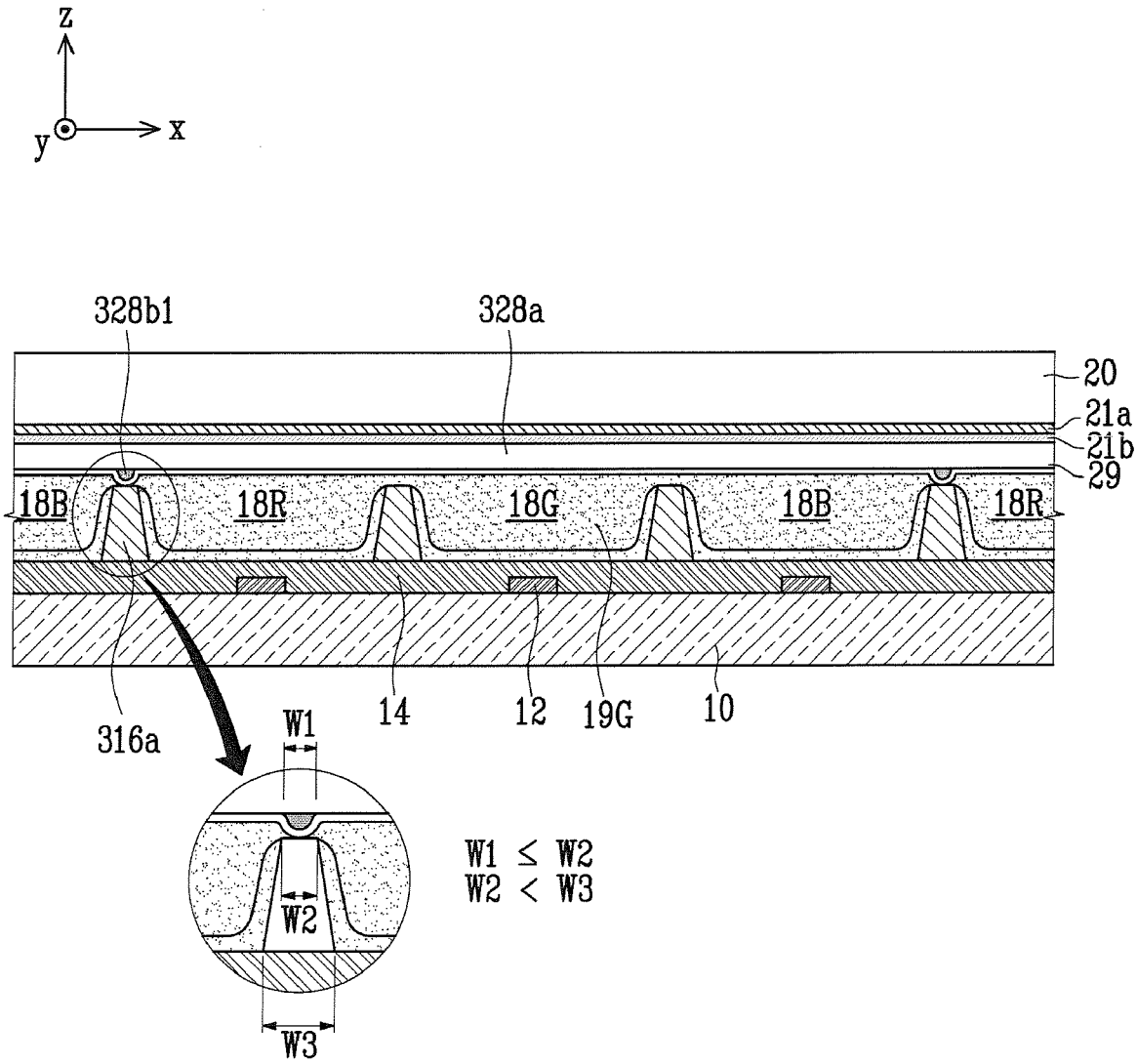
FIG. 17 is a cross-sectional view taken along line II-II of FIG. 16.
Figure 18:
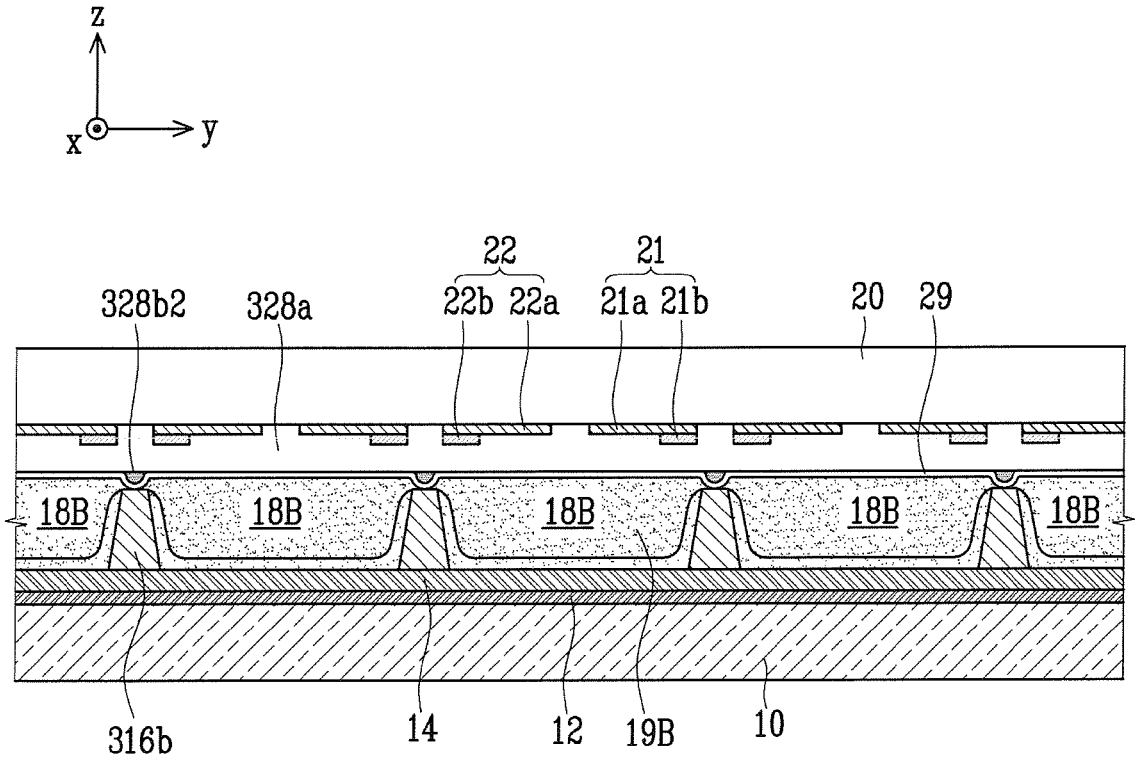
FIG. 18 is a cross-sectional view taken along line III-III of FIG. 16.

FIG. 16 is a partial cutaway perspective view showing a plasma display panel according to an aspect of the present invention. FIG. 17 is a cross-sectional view taken along line II-II of FIG. 16. FIG. 18 is a cross-sectional view taken along line III-III of FIG. 16.

Firstly, the plasma display panel according to this aspect is described with references to FIGS. 16 to 18. When a dielectric layer 328 according to this aspect includes a third refracting member 328*a* and fourth refracting member or members 328*b* having different refractive indexes. The third refracting member 328*a* having a predetermined refractive index is formed over the dielectric layer 328. The fourth refracting members 328*b* are disposed on the third refracting member 328*a* in regions of the front substrate 20 that correspond to boundaries of pixels that are formed according to corresponding colors of phosphor layers 19R, 19G, and 19B.

The fourth refracting member 328*b* may have a semi-cylindrical shape or a convex lens shape. With such a fourth refracting member 328*b*, the visible light rays that are transmitted through the fourth refracting member 328*b* are collected (or refracted) toward a predetermined direction, so that it is possible to reduce or prevent a spreading of the visible light into the adjacent pixels (or a field of view thereof). This is so because in optics, the visible light rays that are transmitted through a convex lens are refracted toward the center of the convex lens. Namely, the visible light rays that are transmitted through the convex lens are collected at a point relative to the convex lens. Accordingly, since the fourth refracting member 328*b* is formed in a semi-cylindrical or a convex lens shape that correspond to the width of the upper end of a first barrier rib 316*a* and/or a second barrier rib 316*b*, the visible light rays from the discharge space of the pixel are refracted toward the inner portion of the fourth refracting member 328*b*. Therefore, it is possible to reduce or prevent a spreading of the visible light that is transmitted through the fourth refracting member 328*b* into the adjacent pixels.

Figure 19:
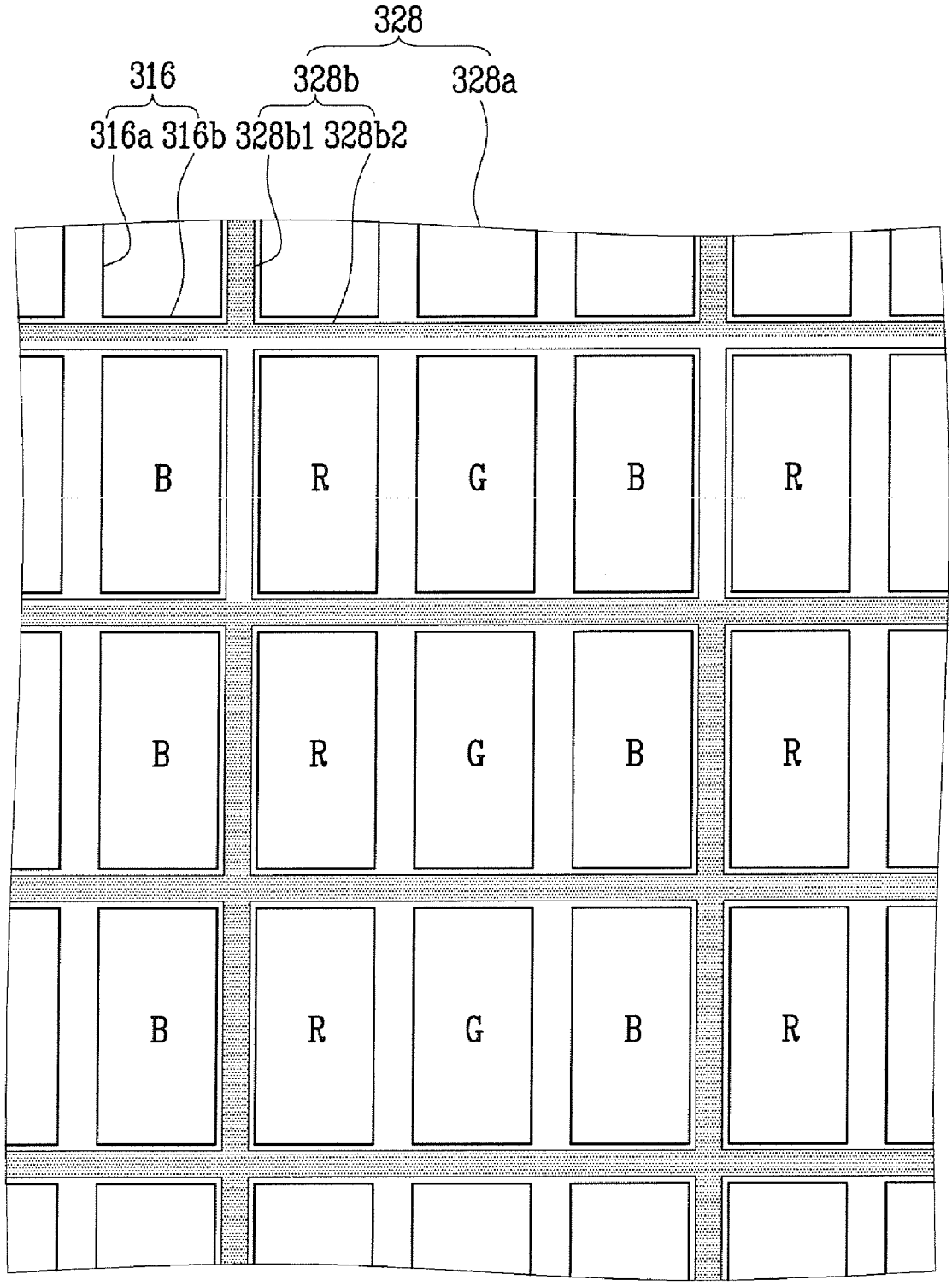
FIG. 19 is a plan view showing an arrangement of third refracting members and fourth refracting members of a dielectric layer of the plasma display panel according to the aspect of FIG. 16.

FIG. 19 is a plan view showing an arrangement of the third refracting member 328*a* and the fourth refracting members 328*b* of a dielectric layer 328 of the plasma display panel according to the aspect of FIG. 16. As shown in FIG. 19, the third refracting member 328*a* and the fourth refracting members 328*b* are shown laid over the pixels and the discharge cells.

Referring to FIG. 19, the fourth refracting members 328*b* are disposed in regions of the front substrate 20 that correspond to the boundaries of the pixels (that is, related red, green, and blue (R, G, B) discharge cells). The third refracting member 328*a* is formed in the regions of the front substrate 20 that exclude the fourth refracting members 328*b*.

In a non-limiting aspect, the fourth refracting members 328*b* include first protruding member or members 328*b*1 and second protruding member or members 328*b*2. The first protruding members 328*b*1 are disposed in regions of the front substrate 20 that correspond to the boundaries between the blue and red discharge cells 18B and 18R among the regions of the front substrate 20 that correspond to the first barrier ribs 316*a*. In other words, the first protruding members 328*b*1 are not disposed in all the regions of the front substrate 20 that correspond to the first barrier ribs 316*a*. Rather, the first protruding members 328*b*1 are disposed in only the regions of the front substrate 20 that correspond to the portions thereof that partition the pixels. Therefore, the first protruding members 328*b*1 are not disposed in the regions thereof that correspond to the boundaries between the red and green discharge cells 18R and 18G and the boundaries between the green and blue discharge cells 18G and 18B from among the regions of the front substrate 20 that correspond to the first barrier ribs 316*a*. The first protruding members 328*b*1 are repeated in the second direction.

On the other hand, the second protruding members 328*b*2 extend in the second direction in all of the regions of the front substrate 20 that correspond to the second barrier ribs 316*b*. The second protruding members 328*b*2 are repeated in the first direction.

Figure 20:
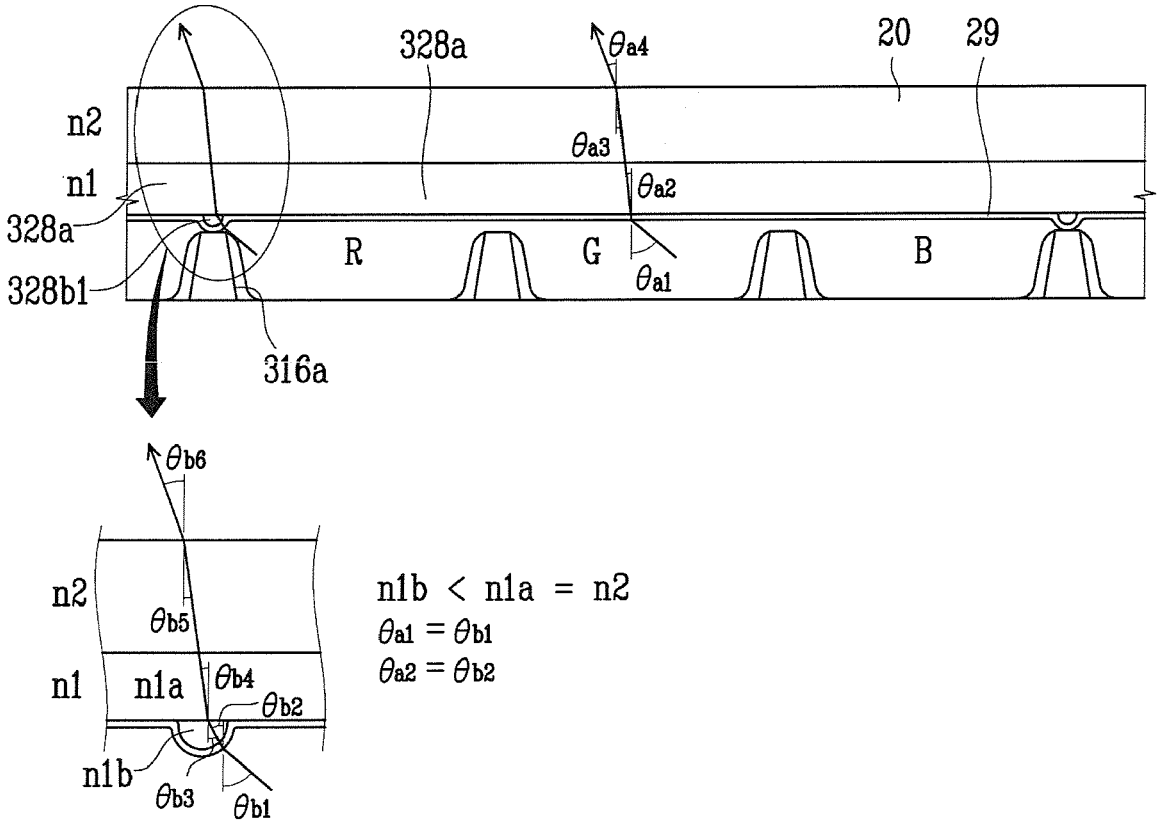
FIG. 20 is a view showing refractive indexes of the dielectric layer and the front substrate with respect to visible light in the plasma display panel according to the aspect of FIG. 16.

FIG. 20 is a view showing refractive indexes of the upper dielectric layer and the front substrate 20 with respect to visible light in the plasma display panel according to the aspect of FIG. 16.

According to this aspect, the refractive index of the third refracting member 328*a* is larger than that of the fourth refracting member 328*b*. In other words, a relationship between the refractive index n1*a* of the third refracting member 328*a* and the refractive index n1*b* of the fourth refracting member 328*b* is n1*a*>n1*b*. The first and second protruding members 328*b*1 and 328*b*2 that are included in the fourth refracting member 328*b* may have the same refractive index, though not required. In other aspects, the refractive index n1*a* of the third refracting member 328*a* may be equal to the refractive index n1*b* of the fourth refracting member 328*b*. Also, the first and second protruding members 328*b*1 and 328*b*2 may have different refractive indexes.

In addition, in a non-limiting aspect, the refractive index of the protective layer 29 may be equal to the refractive index n1*a* of the third refracting member 328*a* or the refractive index n1*b* of the fourth refracting member 328*b*. In such a case, the refraction angle occurring at the interface between the third refracting member 328*a* and the fourth refracting member 328*b* is not changed. In other aspects, the refractive index of the protective layer 29 may be different from the refractive index n1*a* of the third refracting member 328*a* or the refractive index n1*b* of the fourth refracting member 328*b*. In such a case, the refractive index of the protective layer 29 may be smaller than the refractive index n1*a* of the third refracting member 328*a* and/or the refractive index n1*b* of the fourth refracting member 328*b*, though not required.

As shown in FIG. 20, when the incidence angles θal and θb1 of the visible light rays that are incident on the third refracting member 328*a* and the fourth refracting member 328*b* through the protective layer 29, respectively, are equal to each other, the refraction angle θb2 for the fourth refracting member 328*b* that has the smaller refractive index of n1*b* becomes larger than the refraction angle θa2 for the third refracting member 328*a* that has the larger refracting refractive index of n1*a*. Accordingly, when the refractive index n1*a* of the third refracting member 328*a* is larger than the refractive index n1*b* of the fourth refracting member 328*b*, the refraction angle θa2 of the visible light for the third refracting member 328*a* becomes different from the refraction angle θb2 of the visible light for the fourth refracting member 328*b*. In addition, the incidence angles of the visible light incident from the refracting members (328*a*, 328*b*) to the front substrate 20 are also different from each other.

When the visible light that is transmitted through the fourth refracting member 328*b* is incident on the adjacent third refracting member 328*a*, the visible light that is transmitted through the fourth refracting member 328*b* having the smaller refractive index of n1*b* to the third refracting member 328*a* having the larger refractive index of n1*a* is refracted with the refraction angle θb4 that is smaller than the incidence angle θb3 incident on the interface between the third refracting member 328*a* and the fourth refracting member 328*b*. Further, the refraction angle θb6 of the visible light that is refracted at the interface between the front substrate 20 and air is larger than the incidence angle θb5 of the visible light incident on the interface. This is because the refractive index n2 of the front substrate 20 is larger than the refractive index of air.

In this manner, the visible light is transmitted through the fourth refracting member 328*b* into the third refracting member 328*a* that has the larger refractive index, so that it is possible to reduce or prevent spreading of the visible light into the discharge cells of the adjacent pixels (or a field of view thereof).

In a non-limiting aspect, the fourth refracting members 328*b* may be formed in a convex lens shape. In this case, the visible light rays from a pixel are collected in (or directed toward) an inner portion of the fourth refracting member 328*b*, so that the transmission path of the visible light is rendered straighter (or more normal) relative to third refracting member 328*a* and the fourth refracting member 328*b* due to a difference between the refractive index n1*a* of the third refracting member 328*a* and the refractive index n1*b* of the fourth refracting member 328*b*.

As described above, if the refractive index n1*b* of the fourth refracting member 328*b* that is positioned to correspond to the boundaries of the pixels is smaller than the refractive index n1*a* of the third refracting member 328*a*, and if the difference therebetween is designed to be as large as possible, the visible light rays that is transmitted through the fourth refracting member 328*b* are collected toward a predetermined direction, so that it is possible to reduce or prevent spreading of the visible light into the adjacent pixels (or a field of view thereof).

Although not required in all aspects, the refractive index n2 of the front substrate 20 and the refractive index n1*a* of the third refracting member 328*a* may be designed to be equal to each other.

In the following, redundant description of the same elements as those of the aforementioned aspects will be omitted.

Figure 21:
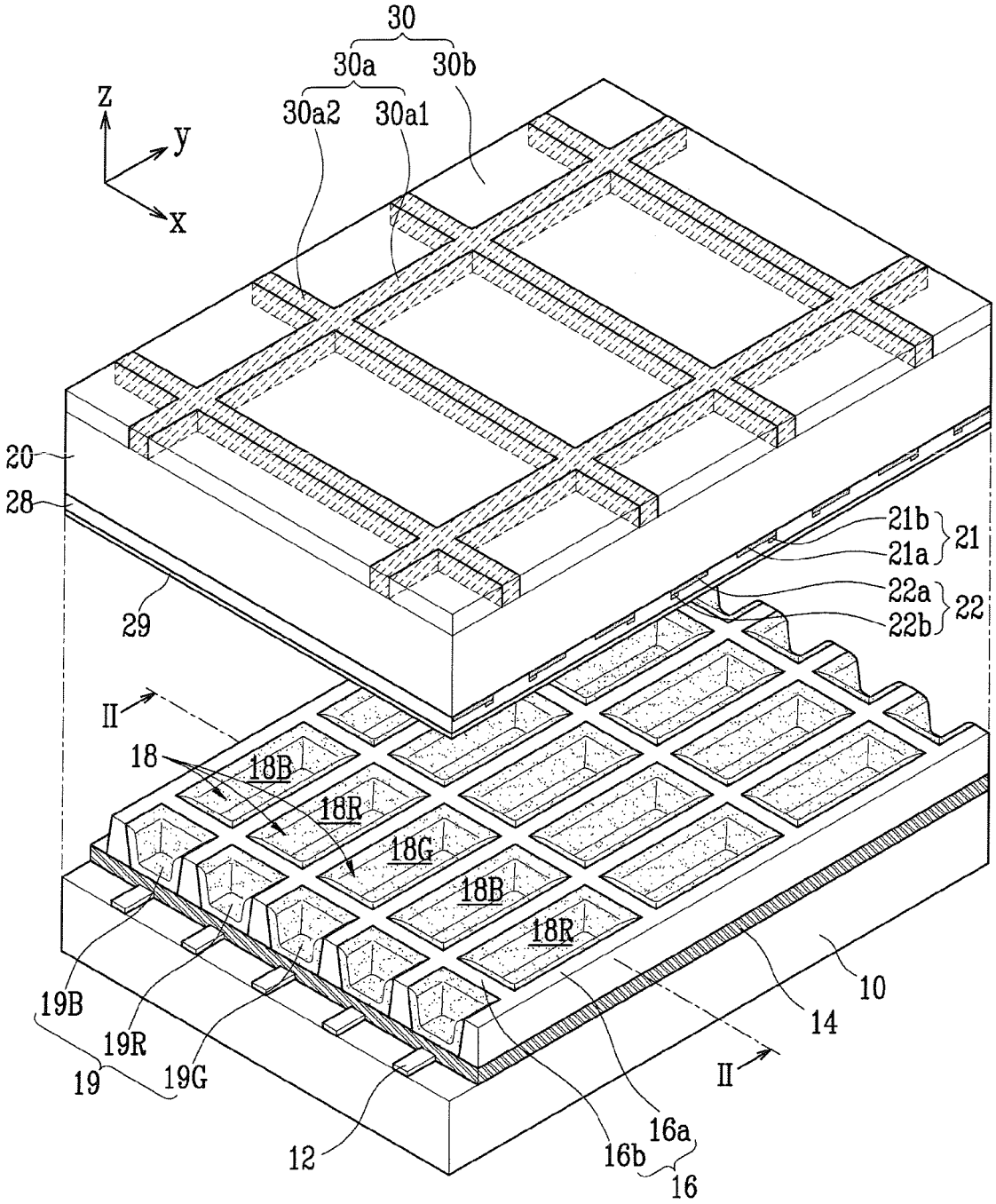
FIG. 21 is a partial cutaway perspective view showing a plasma display panel according to a an aspect of the present invention.
Figure 22:
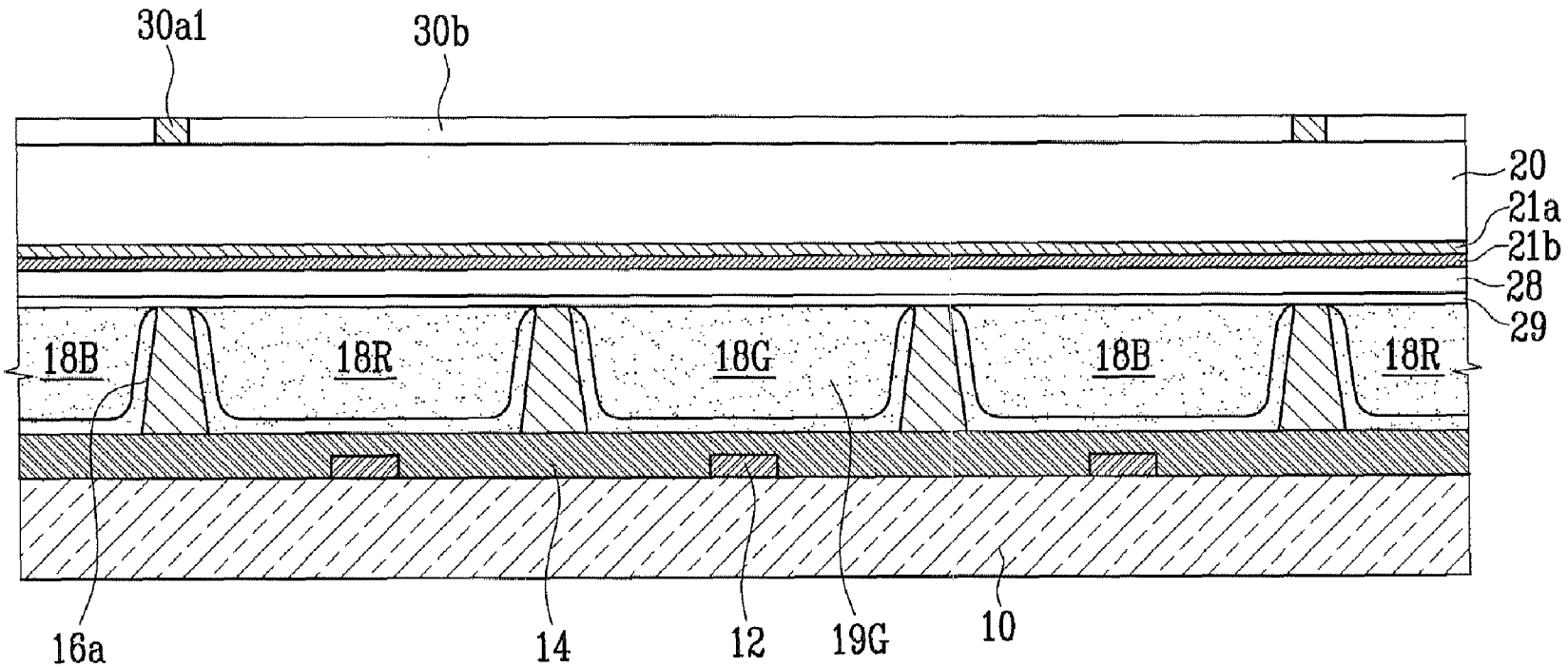
FIG. 22 is a cross-sectional view taken along line II-II of FIG. 21.

FIG. 21 is a partial cutaway perspective view showing a plasma display panel according to an aspect of the present invention. FIG. 22 is a cross-sectional view taken along line II-II of FIG. 21.

Firstly, the plasma display panel according to this aspect is described with references to FIGS. 21 to 22.

In the aspect shown, the plasma display panel includes a first or rear substrate 10, a second or front substrate 20 which faces the rear substrate 10 across a predetermined interval or space, and a filter layer 30 which is disposed (or formed) on the front substrate 20 to cover the front substrate 20. The filter layer 30 according to this aspect includes fifth refracting member or members 30*a* and sixth refracting member or members 30*b* having different refractive indexes. The filter layer 30 may be formed so that the visible light is not spread (or diffused) on the front substrate 20 but propagates toward the front surface thereof. The filter layer 30 may be constructed (or formed) with a film having a predetermined thickness that is attached to the front substrate 20, though not required.

Figure 23:
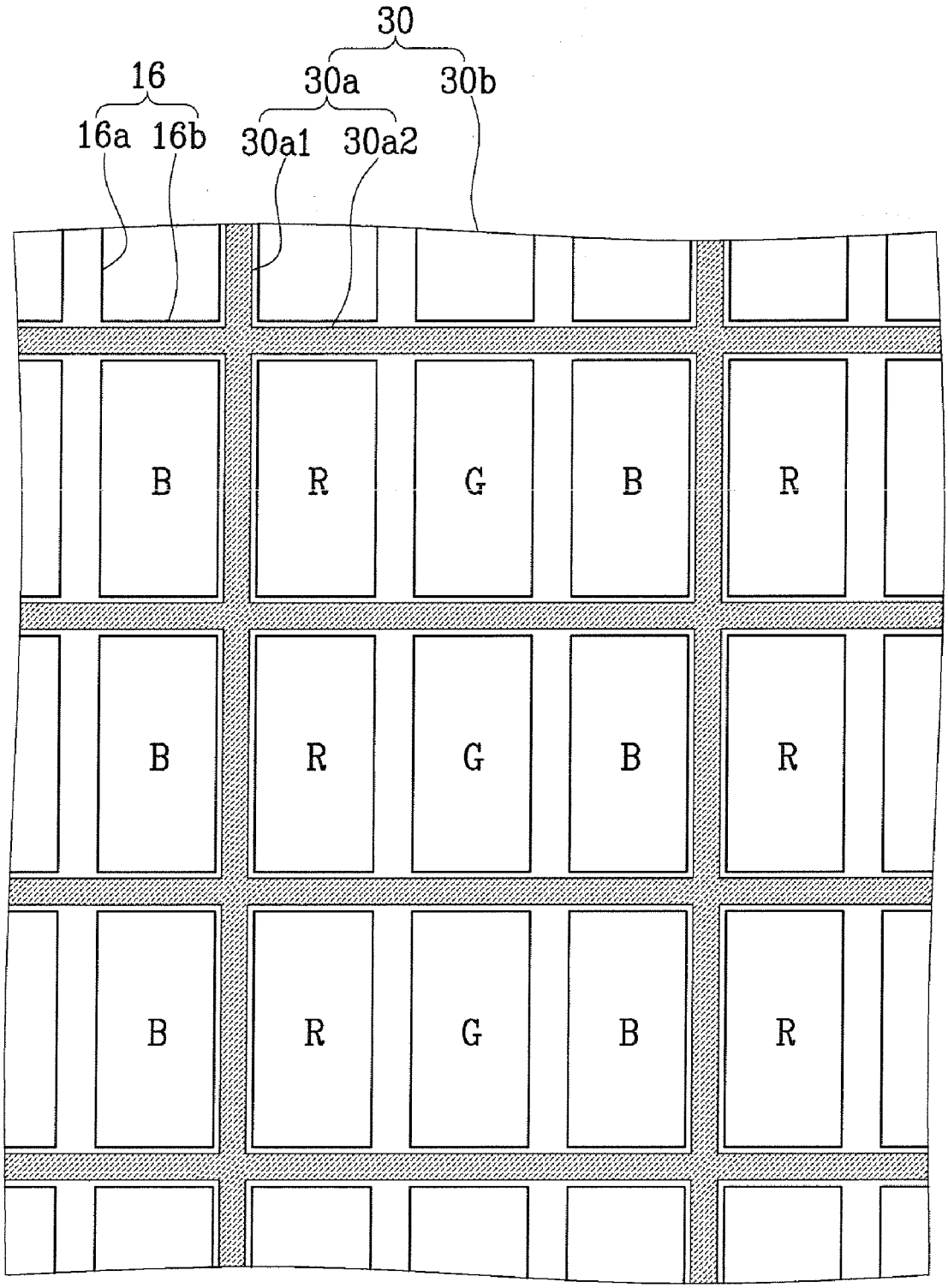
FIG. 23 is a plan view showing an arrangement of fifth refracting members and sixth refracting members of a filter layer of the plasma display panel according to the aspect of FIG. 21.

FIG. 23 is a plan view showing fifth refracting members 30*a* and sixth refracting members 30*b* of the filter layer 30 of the plasma display panel according to the aspect of FIG. 21. Referring to FIG. 23, the fifth refracting members 30*a* are disposed in regions of the front substrate 20 that correspond to the boundaries of the pixels that correspond to colors of the phosphor layers 19R, 19G, and 19B. The sixth refracting members 30*b* are disposed in the regions of the front substrate 20 that exclude the fifth refracting members 30*a*.

In various aspects, the fifth refracting members 30*a* include third material member or members 30*a*1 and fourth material members or members 30*a*2. The third material members 30*a*1 are disposed in regions of the front substrate 20 that correspond to the boundaries between the blue and red discharge cells 18B and 18R among the regions of the front substrate 20 that correspond to the first barrier ribs 16*a*. In other words, the third material members 30*a*1 are not disposed in all of the regions of the front substrate 20 that correspond to the first barrier ribs 16*a*. Rather, the third material members 30*a*1 are disposed in only the regions of the front substrate 20 that correspond to portions that partition the pixels. Therefore, the third material members 30*a*1 are not disposed in the regions of the front substrate 20 that correspond to the boundaries between the red and green discharge cells 18R and 18G and the boundaries between the green and blue discharge cells 18G and 18B among the regions of the front substrate 20 that correspond to the first barrier ribs 16*a*. The third material members 30*a*1 are repeated in the second direction.

The fourth material members 30*a*2 extend in the second direction in all of the regions of the front substrate 20 that correspond to the second barrier ribs 16*b*. The fourth material members 30*a*2 are repeated in the first direction.

Figure 24:
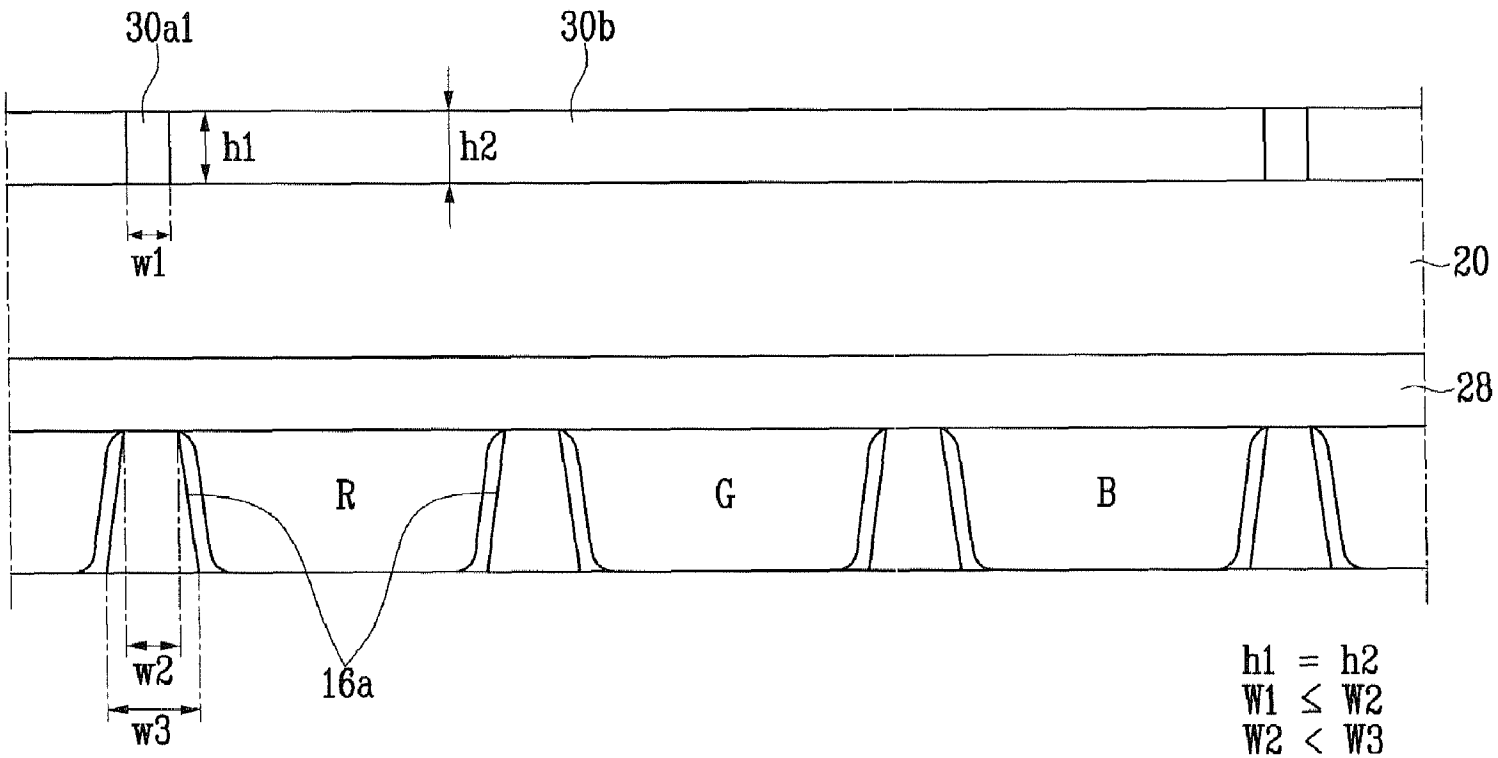
FIG. 24 is a cross-sectional view showing the filter layer and barrier ribs of the plasma display panel according to the aspect of FIG. 21.

FIG. 24 is a cross-sectional view showing the filter layer 30 and barrier ribs of the plasma display panel according to the aspects of FIG. 21. In this aspect, widths of upper (or first) and lower (or second) ends of the barrier ribs may be designed to be different from each other. For example, as shown in FIG. 24, the first barrier rib 16*a* may have a trapezoid shape, so that the width W2 of the upper end of the first barrier rib 16*a* is smaller than the width W3 of the lower end thereof. In addition, the second barrier rib 16*b*, shown in FIG. 21, may also have the same shape as the second barrier rib 16*a*. In various aspects, the inclination of the side of the first and/or second barrier ribs 16*a* and 16*b* may vary. Also, in other aspects, other shapes of the first and/or second barrier ribs 16*a* and 16*b* are possible. For example, the shapes thereof may be triangular, rectangular, and/or similar shapes. Also, the shape of the sides of the first and/or second barrier ribs 16*a* and 16*b* may be curved, straight, something similar, or any combinations thereof.

The width W1 of the fifth refracting member 30*a* may be equal to or smaller than the width W2 of the first barrier rib 16*a*. In addition, the height h1 of the fifth refracting member 30*a* may be equal to the height h2 of the sixth refracting member 30*b*. In other aspects, the width W1 of the fifth refracting member 30*a* may be greater than the width W2 of the second barrier rib 16*b*, and/or the height h1 of the fifth refracting member 30*a* may not be equal to the height h2 of the refracting fifth refracting member 30*a*.

Figure 25:
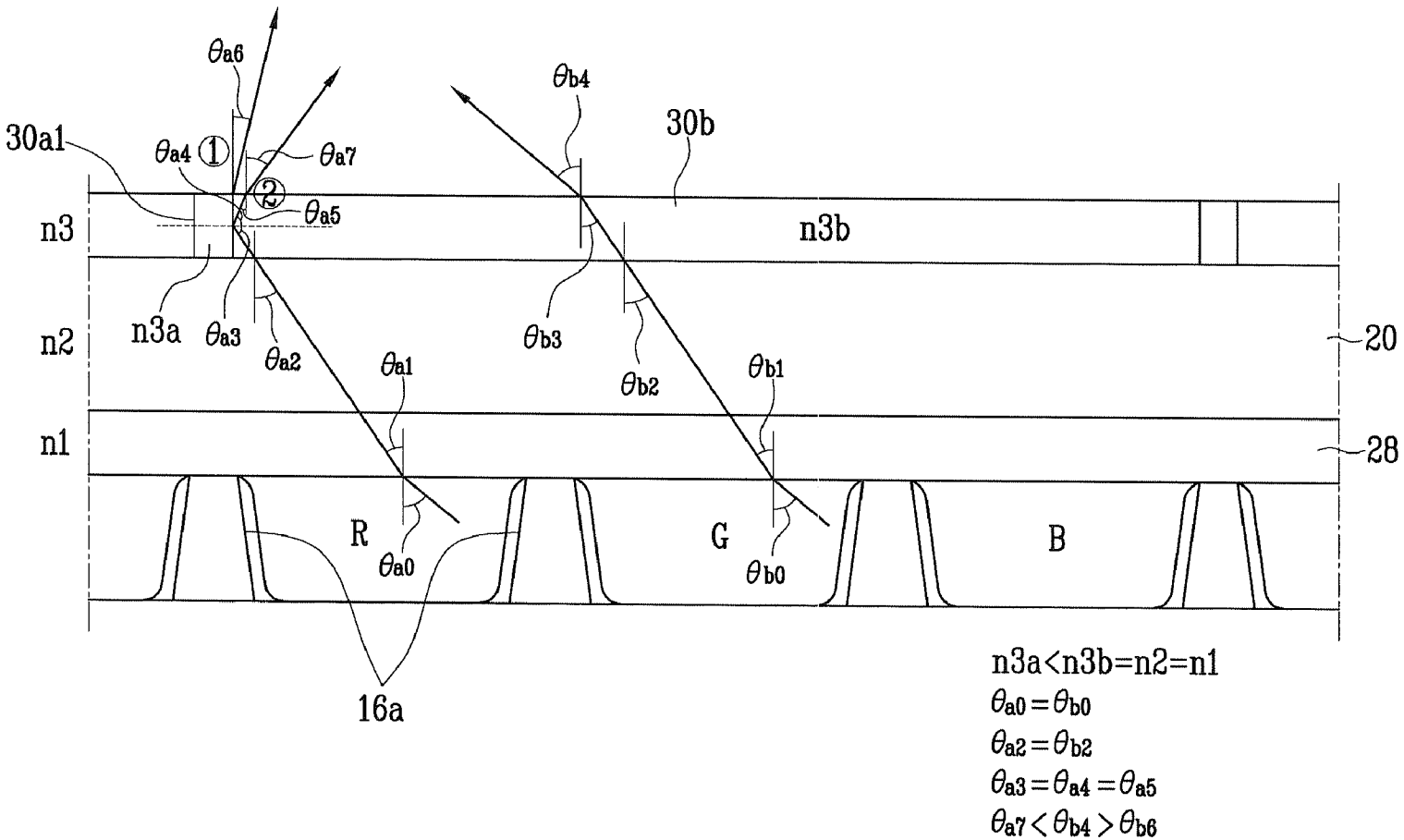
FIG. 25 is a view showing refractive indexes of the dielectric layer, the front substrate, and the filter layer with respect to visible light in the plasma display panel according to the aspect of FIG. 21.

FIG. 25 is a view showing refractive indexes of the dielectric layer 28, the front substrate 20, and the filter layer 30 with respect to visible light in the plasma display panel according to the aspect of FIG. 21.

In the filter layer 30, a refractive index n3*a* of the fifth refracting member 30*a* is smaller than a refractive index n3*b* of the sixth refracting member 30*b*. In other words, a relationship between the refractive index n3*a* of the fifth refracting member 30*a* and the refractive index n3*b* of the sixth refracting member 30*b* is n3*a*<n3*b*. In addition, the third and fourth material members 30*a*1 and 30*a*2 that are included in the fifth refracting member 30*a* may have the same refractive index, in other aspects, although not required.

Accordingly, when the incidence angles of the respective visible light rays that are incident on the fifth refracting member 30*a* and the sixth refracting member 30*b* are equal to each other, the refraction angle of the visible light that is incident on the fifth refracting member 30*a* that has the smaller refractive index becomes larger than the refraction angle of the visible light that is incident on the sixth refracting member 30*b*.

With respect to any visible light that attempts to pass through both the fifth refracting member 30*a* and the sixth refracting member 30*b*, the sixth refracting member 30*b* having the larger refractive index to the fifth refracting member 30*a* having the smaller refractive index will cause a critical incidence angle θa3 of the visible light at the interface therebetween. Accordingly, possibility of a total reflection of the visible light occurs. As discussed above, the critical incidence angle θa3 is determined by a ratio of the refractive index n3*b* of the sixth refracting member 30*b* relative to the refractive index n3*a* of the fifth refracting member 30*a*.

In case of the visible light of which incidence angle is smaller than the critical incidence angle θa3, a portion of the visible light is reflected at the interface between the fifth refracting member 30*a* and the sixth refracting member 30*b*, and the remaining portion of the visible light is refracted by the refraction angle larger than the incidence angle to be transmitted through the fifth refracting member 30*a*.

In the case of the visible light of which the incidence angle is equal to the critical incidence angle θa3, the refraction angle of the visible light is 90° at the interface between and the fifth refracting member 30*a* and the sixth refracting member 30*b* (visible light ray 1). In this case, the refraction angle θa6 of the visible light that is transmitted through the filter layer 30 to air is larger than the incidence angle of 0° at the interface between the filter layer 30 and air. This is because the refractive index n3 of the filter layer 30 is larger than that of air.

In the case of the visible light of which the incidence angle is larger than the critical incidence angle θa3, the reflection angle θa4 of the visible light is equal to the incidence angle so that the visible light undergoes total reflection toward the interface between the filter layer 30 and air (or a field of view of the pixels). (visible light ray 2). In this case, the refraction angle θa7 of the visible light that is transmitted from the filter layer 30 to air is larger than the incidence angle θa5.

As a result, the visible light having the incidence angle equal to or larger than critical incidence angle θa3 cannot be transmitted through the fifth refracting member 30*a*, so that spreading of the visible light into the discharge cells of the adjacent pixels (or field of view thereof) can be reduced or prevented.

Accordingly, in the aspect, total reflection may occur at the interface between the fifth refracting member 30*a* and the sixth refracting member 30*b*. In addition, if the incidence angle (or critical incidence angle) of the visible light that is incident on the fifth refracting member 30*a* is designed to be as large as possible, total reflection can occur effectively (or efficiently). In addition, a difference between the refractive indexes n3*a* and n3*b* of the fifth and sixth refracting members 30*a* and 30*b* may be designed to be as large as possible.

According to aspects of the present invention, a plasma display panel is capable of improving display quality by reducing halation, which is a spread of visible light into adjacent discharge cells due to refraction or total reflection and increasing the transmittance of the visible light.

In various aspects, the front substrate with or without the various layers may be attached directly to the respective barrier ribs.

In various aspects shown, refractive indexes and angles designations do not necessarily indicate like refractive indexes and angles.

In various aspects, the descriptions of regions of the front substrate include not only regions directly on the front substrate but also regions that are not on the front substrate, but at positions that correspond to such regions of the front substrate.

In various aspects, although discussed in terms of visible light, aspects of the present invention are applicable to any wavelength light and/or electromagnetic radiation.

In various aspects, although air is discussed in terms of being the last medium to refract the visible light, aspects of the present invention are applicable to one or more media substituting air in the above descriptions.

In various aspects, a field of view refers to an approximate area.

In various aspects, the front substrate and/or the various layers may have a smoothly varying refraction indexes from one end to another end thereof.

Although a few aspects of the present invention have been shown and described, it would be appreciated by those skilled in the art that changes may be made in the aspects without departing from the principles and spirit of the invention, the scope of which is defined in the claims and their equivalents.

What is claimed is:

1. A plasma display panel comprising:

a first substrate;

a second substrate facing the first substrate;

barrier ribs disposed between the first substrate and the second substrate to partition a plurality of discharge cells;

address electrodes formed on the first substrate to extend in a first direction to correspond to the discharge cells;

display electrodes formed on the second substrate to extend in a second direction that intersects the first direction and to correspond to the discharge cells; and a dielectric layer formed directly on the second substrate to cover the display electrodes, wherein a refractive index of the dielectric layer is smaller than a refractive index of the second substrate.

2. A plasma display panel comprising:

a first substrate;

a second substrate facing the first substrate;

barrier ribs disposed between the first substrate and the second substrate to partition a plurality of discharge cells;

address electrodes formed on the first substrate to extend in a first direction corresponding to the discharge cells;

display electrodes formed on the second substrate to extend in a second direction intersecting the first direction corresponding to the discharge cells; and a dielectric layer formed on the second substrate to cover the display electrodes, wherein the dielectric layer includes a plurality of sub-layers each having different refractive indexes, and the refractive index of each of the plurality of the sub-layers is inversely proportional to a distance from each of the plurality of sub-layers to the second substrate.

3. The plasma display panel of claim 2, further comprising a protective layer covering the dielectric layer, wherein a refractive index of the protective layer is smaller than the refractive index of each of plurality of the sub-layers.

4. A plasma display panel comprising:

a first substrate;

a second substrate facing the first substrate;

barrier ribs disposed between the first substrate and the second substrate to partition a plurality of discharge cells;

address electrodes formed on the first substrate to extend in a first direction corresponding to the discharge cells;

display electrodes formed on the second substrate to extend in a second direction intersecting the first direction corresponding to the discharge cells; and a dielectric layer formed on the second substrate to cover the display electrodes, wherein the dielectric layer comprises:

refracting members; and refracting grooves that are hollowed portions of the refracting members.

5. The plasma display panel of claim 4, wherein a refractive index of the refracting groove is smaller than a refractive index of the refracting member.

6. The plasma display panel of claim 5, wherein the barrier ribs include:

first barrier ribs disposed to extend in the first direction; and second barrier ribs disposed to extend in the second direction, and the refracting grooves are disposed to correspond to the second barrier ribs.

7. The plasma display panel of claim 4, wherein a width of the refracting groove is smaller than a width of one end of the barrier rib.

8. A plasma display panel comprising:

a first substrate;

a second substrate facing the first substrate;

barrier ribs disposed between the first substrate and the second substrate to partition a plurality of discharge cells;

address electrodes formed on the first substrate to extend in a first direction corresponding to the discharge cells;

display electrodes formed on the second substrate to extend in a second direction intersecting the first direction corresponding to the discharge cells; and a dielectric layer formed on the second substrate to cover the display electrodes, wherein the dielectric layer comprises:

first refracting members disposed in regions of the second substrate that correspond to boundaries of pixels that include one of each colors of the discharge cells, and second refracting members disposed in regions of the second substrate that exclude the first refracting members.

9. The plasma display panel of claim 8, wherein a refractive index of the first refracting member is smaller than a refractive index of the second refracting member.

10. The plasma display panel of claim 9, wherein a width of the first refracting member is equal to or smaller than a width of one end of the barrier rib.

11. The plasma display panel of claim 9, further comprising blue and red discharge cells, wherein the barrier ribs include:

first barrier ribs to extend in the first direction, and second barrier ribs to extend in the second direction: and wherein the second refracting members include:

first material members disposed to correspond to the first barrier ribs forming boundaries between the blue and red discharge cells, and second material members disposed to correspond to the second barrier ribs.

12. The plasma display panel of claim 8, wherein the first refracting members protrude from the second refracting member toward the first substrate.

13. The plasma display panel of claim 12, wherein a width of the first refracting member is equal to or smaller than a width of one end of the barrier ribs.

14. The plasma display panel of claim 12, wherein the first refracting member has a semicircular and/or a semielliptical cross section.

15. The plasma display panel of claim 12, further comprising blue and red discharge cells, wherein the barrier ribs include:

first barrier ribs to extend in the first direction, and second barrier ribs to extend in the second direction; and wherein the first refracting members include:

first protruding members disposed to correspond to the first barrier ribs forming boundaries between the blue and red discharge cells, and second protruding members disposed to correspond to the second barrier ribs.

16. A plasma display panel comprising:

a first substrate;

a second substrate facing the first substrate;

barrier ribs disposed between the first and second substrates to partition a plurality of discharge cells;

address electrodes formed on the first substrate to extend in a first direction to correspond to the discharge cells;

display electrodes formed on the second substrate to extend in a second direction that intersects the first direction and to correspond to the discharge cells; and a filter layer disposed on an outer surface of the second substrate, wherein the filter layer comprises:

first refracting members disposed in regions of the second substrate that correspond to boundaries of pixels that include one of each color of the discharge cells, and second refracting members disposed in regions of the second substrate that exclude the first refracting members and have refractive indexes which are different from those of the first refracting members.

17. The plasma display panel of claim 16, wherein the refractive index of the second refracting member is smaller than the refractive index of the first refracting member.

18. The plasma display panel of claim 17, wherein a width of the second refracting member is equal to or smaller than a width of one end of the barrier ribs.

19. The plasma display panel of claim 16, further comprising blue and red discharge cells, wherein:

the barrier ribs include;

first barrier ribs to extend in the first direction, and second barrier ribs to extend in the second direction; and the first refracting members include:

first material members disposed to correspond to the first barrier ribs forming boundaries between the blue and red discharge cells; and second material members disposed to correspond to the second barrier ribs.

20. The plasma display panel of claim 19, wherein a refractive index of the first material member is equal to a refractive index of the second material member.

* * * * *